US012606922B2

(12) United States Patent
Ho et al.

(10) Patent No.: US 12,606,922 B2
(45) Date of Patent: Apr. 21, 2026

(54) $CuWO_4$ HOLLOW NANOSPHERE AND METHODS OF MAKING THEREOF

(71) Applicant: City University of Hong Kong, Hong Kong (CN)

(72) Inventors: Johnny Chung Yin Ho, Hong Kong (CN); Dong Chen, Hong Kong (CN); Shaoce Zhang, Hong Kong (CN); Xiuming Bu, Hong Kong (CN); Quan Quan, Hong Kong (CN)

(73) Assignee: CITY UNIVERSITY OF HONG KONG, Hong Kong (HK)

( * ) Notice: Subject to any disclaimer, the term of this patent is extended or adjusted under 35 U.S.C. 154(b) by 607 days.

(21) Appl. No.: 18/145,913

(22) Filed: Dec. 23, 2022

(65) Prior Publication Data

US 2024/0209528 A1 Jun. 27, 2024

(51) Int. Cl.

| | |
|---|---|
| ***C25B 11/091*** | (2021.01) |
| ***C25B 1/27*** | (2021.01) |
| ***C25B 11/02*** | (2021.01) |
| ***C25B 11/052*** | (2021.01) |

(52) U.S. Cl.

CPC ..... *C25B 11/091* (2021.01); *C25B 11/02* (2013.01); *C25B 11/052* (2021.01); *C25B 1/27* (2021.01)

(58) Field of Classification Search

CPC ..... C25B 11/091; C25B 11/02; C25B 11/052; C25B 1/27

See application file for complete search history.

(56) References Cited

U.S. PATENT DOCUMENTS 5,470,549 A * 11/1995 Dorfman ..... H01H 1/025 423/61

FOREIGN PATENT DOCUMENTS

CN 111534835 A * 8/2020 ..... C25B 11/091
WO WO2000017106 A * 3/2000

OTHER PUBLICATIONS

Anupriya et al. Chemosphere 2022, 296, 133997 (Year: 2022).*
Han et al. Nano Energy 2021, 79, 105492 (Year: 2021).*
Hill et al. Energy Environ. Sci. 2013, 6, 2440 (Year: 2013).*
Li et al. J. Colloid. Int. Sci. 2018, 26, 459-469 (Year: 2018).*
Paparoni et al. Adv. Mater. Interfaces 2022, 9, 2200453 (Year: 2022).*
Schwarz et al. Inorg. Chem. 2007, 46, 2 (Year: 2007).*
Singh et al. J.Mater. Sci. 2019, 30, 20758-20769 (Year: 2019).*
Wu et al. CN111534835A English (Year: 2020).*

(Continued)

*Primary Examiner* — Sally A Merkling
*Assistant Examiner* — Jordan W Taylor
(74) *Attorney, Agent, or Firm* — Heslin Rothenberg Farley & Mesiti P.C.

(57) ABSTRACT

Electrochemical conversion of nitrate to ammonia is an approach to alleviate nitrate pollution in water and simultaneously generate green $NH_3$ fuels. The practical application of this approach is challenging due to the lack of efficient electrocatalysts. The present disclosure relates generally to an electrocatalyst including a plurality of $CuWO_4$ hollow nanospheres, which include asymmetric oxygen vacancies and adjacent Mo clusters, and methods of making and using the same. The electrocatalyst of the present disclosure is designed for efficient ammonia electrosynthesis.

17 Claims, 22 Drawing Sheets

(56) References Cited

OTHER PUBLICATIONS

Yu et al. Adv. Sci. 2020, 7, 1901970 (Year: 2020).*
Lundberg et al., "Nitrate, bacteria and human health", Nature Reviews, Microbiology, vol. 2, pp. 593-602. Jul. 2004.
Chen et al., "Beyond fossil fuel-driven nitrogen transformations", Science 360, vol. 873, 9 pages. May 25, 2018.
Jia et al., "Boosting Selective Nitrate Electroreduction to Ammonium by Constructing Oxygen Vacancies in TiO2", ACS Catalysis, vol. 10, pp. 3533-3540. 2020.
Ostrom et al., "Nitrogen Transformations And No3 2 Removal At A Soil-Stream Interface: A Stable Isotope Approach", Ecological Applications, vol. 12(4), pp. 1027-1043. 2002.
Smith et al., "Current and future role of Haber-Bosch ammonia in a carbon-free energy landscape", Energy & Environmental Science, Royal Society of Chemistry, vol. 13, pp. 331-344. 2020.
Suryanto et al., "Challenges and prospects in the catalysis of electroreduction of nitrogen to ammonia", Nature Catalysis, vol. 2, pp. 290-296. Apr. 2019.
Zeng et al., "Restoring the Nitrogen Cycle by Electrochemical Reduction of Nitrate: Progress and Prospects", Small Methods, vol. 4, 28 pages. 2020.
Stirling et al., "Density functional study of nitrogen oxides", J. Chem. Phys. vol. 100, 15 pages. 1994.
Van Langevelde et al., "Electrocatalytic Nitrate Reduction for Sustainable Ammonia Production", CellPress, Joule 5, pp. 290-294 Feb. 17, 2021.
Yu et al., "Synergy of ferroelectric polarization and oxygen vacancy to promote CO2 photoreduction", Nature Communications, vol. 12, 10 pages. 2021.
Mao et al., "Hydrogen Spillover to Oxygen Vacancy of TiO2-xHy/Fe: Breaking the Scaling Relationship of Ammonia Synthesis" Journal of the Americal Chemical Society, vol. 142, pp. 17403-17412. 2020.
Feng et al., "Maintaining stable LSPR performance of W18O49 by protecting its oxygen vacancy: A novel strategy for achieving durable sunlight driven photocatalysis", Applied Catalysis B: Enivronmental, vol. 276, 9 pages. 2020.
Ding et al., "Ru-doped, oxygen-vacancy-containing CeO2 nanorods toward N2 electroreduction", Journal of Materials Chemistry A, Royal Society of Chemistry, vol. 8, pp. 7229-7234. 2020.
Tang et al., "Fabrication of Oxygen-Vacancy Abundant NiMn-Layered Double Hydroxides for Ultrahigh Capacity Supercapacitors", Advanced Functional Materials, vol. 30, 9 pages. 2020.
Mcfarland et al., "Catalysis by Doped Oxides", ACS Publications, Chem. Rev., vol. 113, pp. 4391-4427. 2013.
Medford et al., "From the Sabatier principle to a predictive theory of transition-metal heterogeneous catalysis", Journal of Catalysis, vol. 328, pp. 36-42. 2015.
Li et al., "Recent advances in POM-organic frameworks and POM-organic polyhedra", Coordination Chemistry Reviews, vol. 397, pp. 220-240. 2019.
Pan et al., "Activity and Stability Boosting of an Oxygen-Vacancy-Rich BiVO4 Photoanode by NiFe—MOFs Thin Layer for Water Oxidation", Angew. Chem. Int., Ed., vol. 60, pp. 1433-1440. 2021.
Yu et al., "Asymmetric Oxygen Vacancies: the Intrinsic Redox Active Sites in Metal Oxide Catalysts", Advance Sciences, vol. 7, 8 pages. 2020.
Yang et al., "O-coordinated W—Mo dual-atom catalyst for pH-universal electrocatalytic hydrogen evolution", Science Advances, vol. 6, 13 pages. Jun. 5, 2020.
Wang et al., "Confined Fe—Cu Clusters as Sub-Nanometer Reactors for Efficiently Regulating the Electrochemical Nitrogen Reduction Reaction", Advanced Materials, vol. 32, 9 pages. 2020.
Yu et al., "The role of Bi-doping in promoting electron transfer and catalytic performance of Pt/3DOM-Ce1-xBixO2-d", Journal of Catalysis, vol. 365, pp. 292-302. 2018.
Yang et al., "Oxygen Vacancy Promoted 02 Activation over Perovskite Oxide for Low-Temperature CO Oxidation", ACS Catalysis, vol. 9, pp. 9751-9763. 2019.
Xiao et al., "Operando Identification of the Dynamic Behavior of Oxygen Vacancy-Rich Co3O4 for Oxygen Evolution Reaction", Journal of the American Chemical Society, vol. 142, pp. 12087-12095. 2020.
Xiu et al., "Multilevel Hollow MXene Tailored Low-Pt Catalyst for Efficient Hydrogen Evolution in Full-pH Range and Seawater", Advanced Functional Materials, vol. 30, 10 pages. 2020.
Souza et al., "Structural evolution, growth mechanism and photoluminescence properties of CuWO4 nanocrystals", Ultrasonics Sonochemistry, vol. 38, pp. 256-270. 2017.
Figueiredo et al., "Nitrate Reduction on Noble Metal Electrodes", Elsevier Inc., pp. 761-768. 2018.
Han et al., "Plasma-induced oxygen vacancies in amorphous MnOx boost catalytic performance for electrochemical CO2 reduction", Nano Energy, vol. 79, 8 pages. 2021.
Lou et al., "Hollow Micro-/Nanostructures: Synthesis and Applications", Advanced Materials, vol. 20, pp. 3987-4019. 2008.
Garcia-Segura et al., "Electrocatalytic reduction of nitrate: Fundamentals to full-scale water treatment applications", Applied Catalysis B: Environmental, vol. 236, pp. 546-568. 2018.
Chen et al., "Electrochemical reduction of nitrate to ammonia via direct eight-electron transfer using a copper-molecular solid catalyst", Nature Energy, vol. 5, pp. 605-613. Aug. 2020.
Choi et al., "Suppression of Hydrogen Evolution Reaction in Electrochemical N2 Reduction Using Single-Atom Catalysts: A Computational Guideline", ACS Catalysis, vol. 8, pp. 7517-7525. 2018.
Ding et al., "Structure and photocatalytic activity of thin-walled CuWO4 nanotubes: An experimental and DFT study", Materials Letters, vol. 253, pp. 323-236. 2019.
Deng et al., "Metallic Co Nanoarray Catalyzes Selective NH3 Production from Electrochemical Nitrate Reduction at Current Densities Exceeding 2 A cm-2", Advanced Science, vol. 8, 9 pages. 2021.
Chen et al., "Tailoring the d-Band Centers Enables Co4N Nanosheets To Be Highly Active for Hydrogen Evolution Catalysis", Angew. Chem. vol. 130, pp. 5170-5174. 2018.
Gonzalez et al., "Periplasmic nitrate reductases and formate dehydrogenases: Biological control of the chemical properties of Mo andWfor fine tuning of reactivity, substrate specificity and metabolic role", Coordination Chemistry Reviews, vol. 257, pp. 315-331. 2013.
Guo et al., "Pd doping-weakened intermediate adsorption to promote electrocatalytic nitrate reduction on TiO2 nanoarrays for ammonia production and energy supply with zinc-nitrate batteries", Energy & Environmental Science, vol. 14, pp. 3938-3944. 2021.
Guo et al., "Insights into the multiple effects of oxygen vacancies on CuWO4 for photoelectrochemical water oxidation", Catalysis Science & Technology, vol. 10, pp. 7344-7351. 2020.
Chu et al., "Mo-doped SnS2 with enriched S-vacancies for highly efficient electrocatalytic N2 reduction: the critical role of the Mo—Sn—Sn trimer", Journal of Material Chemistry A, vol. 8, pp. 7117-7124. 2020.
Bi et al., "Tuning oxygen vacancy content in TiO2 nanoparticles to enhance the photocatalytic performance", Chemical Engineering Science, vol. 234, 9 pages. 2021.
Bo et al., "Altering Hydrogenation Pathways in Photocatalytic Nitrogen Fixation by Tuning Local Electronic Structure of Oxygen Vacancy with Dopant", Angew. Chem. Int. Ed., vol. 60, pp. 16085-16092. 2021.
Chu et al., "Creating defects on graphene basal-plane toward interface optimization of graphene/CuCr composites", Carbon, vol. 143, pp. 85-96. 2019.
An et al., "2D Metal Zn Nanostructure Electrodes for High-Performance Zn Ion Supercapacitors", Advanced Energy Materials, vol. 10, 9 pages. 2020.
Han et al., "Atomically Dispersed Molybdenum Catalysts for Efficient Ambient Nitrogen Fixation", Angew. Chem., vol. 131, pp. 2343-2347. 2019.
Lee et al., "Hierarchically assembled tubular shell-core-shell heterostructure of hybrid transition metal chalcogenides for high-performance supercapacitors with ultrahigh cyclability", Nano Energy, vol. 37, pp. 15-23. 2017.

(56) References Cited

OTHER PUBLICATIONS

Li et al., "A single-site iron catalyst with preoccupied active centers that achieves selective ammonia electrosynthesis from nitrate", Energy & Environmental Science, Rotal Society of Chemistry, vol. 14, pp. 3522-3531. 2021.
Li et al., "Efficient Ammonia Electrosynthesis from Nitrate on Strained Ruthenium Nanoclusters", Journal of the American Chemical Society, vol. 142, pp. 7036-7046. 2020.
Ma et al., "Synergizing Mo Single Atoms and Mo2C Nanoparticles on CNTs Synchronizes Selectivity and Activity of Electrocatalytic N2 Reduction to Ammonia", Advanced Materials, vol. 32, 8 pages. 2020.
Shi et al., "High-performance water gas shift induced by asymmetric oxygen vacancies: Gold clusters supported by ceria-praseodymia mixed oxides", Applied Catalysis B: Environmental, vol. 301, 13 pages. 2022.
Wang et al., "Atomically Dispersed Mo Supported on Metallic Co9S8 Nanoflakes as an Advanced Noble-Metal-Free Bifunctional Water Splitting Catalyst Working in Universal pH Conditions", Advanced Energy Materials, vol. 10, 14 pages. 2020.
Jiao et al., "Electrochemical Ammonia Synthesis and Ammonia Fuel Cells", Advanced Materials, vol. 31, 5 pages. 2019.
Xie et al., "High-Efficiency Electrosynthesis of Ammonia with Selective Reduction of Nitrate in Neutral Media Enabled by Self-Supported Mn2CoO4 Nanoarray", ACS Applied Materials & Interfaces, vol. 14, pp. 33242-33247. 2022.
Ye et al., "Elucidating the activity, mechanism and application of selective electrosynthesis of ammonia from nitrate on cobalt phosphide", Energy & Environmental Science, Royal Society of Chemistry, vol. 15, pp. 760-770. 2022.
Yu et al., "Asymmetric Oxygen Vacancies: the Intrinsic Redox Active Sites in Metal Oxide Catalysts", Advanced Science, vol. 7, 8 pages. 2020.
Zhao et al., "Spontaneous Formation of Asymmetric Oxygen Vacancies in Transition-Metal-Doped Ce02 Nanorods with Improved Activity for Carbonyl Sulfide Hydrolysis", ACS Catalysis, vol. 10, pp. 11739-11750. 2020.

* cited by examiner

$CuWO_4$ HOLLOW NANOSPHERE AND METHODS OF MAKING THEREOF

FIELD

The present disclosure relates generally to electrocatalysts including $CuWO_4$ hollow nanospheres, and methods of making and using thereof.

BACKGROUND

The removal or conversion of nitrate ($NO_x^-$ species) in agricultural sewage is highly desired because nitrate causes severe damage to aquatic ecosystems and underground water, and eventually poses a threat to human health. Fortunately, nitrate may be converted into ammonia ($NH_3$), which plays a significant role in the nitrogen cycle and may be used as a raw material in hydrogen-rich fuels in the industry. There are two typical pathways to produce ammonia: the conventional Haber-Bosch process, which requires complicated chemical reactions between $N_2$ and $H_2$ implemented at high temperatures and pressures, and the electrochemical nitrogen reduction reaction ($NO_3RR$), which, although it may be executed at ambient conditions, has a much lower yield rate than the Haber-Bosch process. The $NO_3RR$ involves eight-electron transfer processes and is competitive with the undesired hydrogen evolution reaction (HER). Therefore, there is a need for electrocatalysts with high selectivity and efficiency toward $NH_3/NH_4^+$.

SUMMARY

The present disclosure offers advantages, benefits, and other alternatives over known compositions and methods, by providing electrocatalysts, and methods of making and using thereof, that are highly selective and efficient.

In an aspect, provided is a method of making a catalyst, including: forming a $CuWO_4$ hollow nanosphere by a hydrothermal process followed by a thermal treatment; plasma-treating the $CuWO_4$ hollow nanosphere with a plasma to introduce oxygen vacancies; and introducing Mo clusters adjacent to the oxygen vacancies; wherein the hydrothermal process comprises mixing a copper source, a tungsten source, and an adjuvant to form a solution, heating the solution to form a precursor precipitate, and drying the precursor precipitate; and wherein the thermal treatment comprises annealing the precursor precipitate to form a $CuWO_4$ hollow nanosphere.

In an example, the copper source is a water-soluble copper salt, the tungsten source is a water-soluble tungsten salt, and the adjuvant is sodium citrate dihydrate ($C_6H_5O_7Na_3 \cdot 2H_2O$). In another example, a ratio of copper source:adjuvant:tungsten source is in a range of about 1:1:0.5 to about 1:1:1.

In yet another example, heating is performed at a temperature in a range of about 160° C. to about 180° C. for about 22 hours to about 26 hours.

In an example, annealing the precursor precipitate is performed at a temperature in a range of about 350° C. to about 450° C. for about 1 hour to about 2hours.

In another example, plasma-treating includes one or both of (i) exposing the $CuWO_4$ hollow nanosphere to a plasma for about 300 seconds to about 600 seconds; and (ii) exposing the $CuWO_4$ hollow nanosphere to a plasma with RF power about 200 W and gas flow in a range of about 10 sccm to about 20 sccm. In yet another example, the plasma is Ar or $N_2$ and the $CuWO_4$ hollow nanosphere has a high concentration of oxygen vacancies. In still another example, the plasma is $O_2$ and the $CuWO_4$ hollow nanosphere has a low concentration of oxygen vacancies.

In a further example, introducing Mo clusters includes (i) mixing polyoxomolybdate and the plasma-treated $CuWO_4$ hollow nanosphere in water and evaporating the solution to obtain a powder comprising the plasma-treated $CuWO_4$ hollow nanosphere with Mo cluster inclusions; and (ii) annealing the powder at a temperature in a range of about 80° C. to about 100° C. for about 1 hour to about 2 hours in $H_2$/Ar atmosphere.

In an aspect, provided is a catalyst including: a $CuWO_4$ hollow nanosphere; asymmetric oxygen vacancies within the $CuWO_4$ hollow nanosphere; and Mo clusters within the $CuWO_4$ hollow nanosphere, wherein the Mo clusters are adjacent to the asymmetric oxygen vacancies. In an example, the concentration of asymmetric oxygen vacancies is low. In another example, the concentration of asymmetric oxygen vacancies is high.

In yet another example, the diameter of the $CuWO_4$ hollow nanosphere is in a range of about 300 nm to about 450 nm.

In still another example, the catalyst is made by a method including: forming a $CuWO_4$ hollow nanosphere by a hydrothermal process followed by a thermal treatment; plasma-treating the $CuWO_4$ hollow nanosphere with a plasma to introduce oxygen vacancies; and introducing Mo clusters adjacent to the oxygen vacancies; wherein the hydrothermal process comprises mixing a copper source, a tungsten source, and an adjuvant to form a solution, heating the solution to form a precursor precipitate, and drying the precursor precipitate; and wherein the thermal treatment comprises annealing the precursor precipitate to form a $CuWO_4$ hollow nanosphere.

In an aspect, provided is a method of preparing an electrode for nitrate reduction, the method including: forming a solution comprising a plurality of $CuWO_4$ hollow nanospheres and Nafion; sonicating the solution to form a homogeneous catalyst ink; and applying the catalyst ink to a support to obtain the electrode. In an example, the solution further includes one or more of ethanol, acetone, or water, or any combination thereof. In another example, the electrode exhibits one or both of (i) a high $NH_3$ Faradaic efficiency of about 94.60±3.75%, and (ii) a yield rate of about 5.84±0.45 mg $h^{-1}$ $mg_{cat.}^{-1}$ at −0.7 V versus RHE.

In yet another example, the $CuWO_4$ hollow nanospheres includes: $CuWO_4$, wherein each O atom is linked to at least one W atom and at least one Cu atom; asymmetric oxygen vacancies; and Mo clusters, wherein the Mo clusters are adjacent to the asymmetric oxygen vacancies. In still another example, the concentration of asymmetric oxygen vacancies is low. In a further example, the concentration of asymmetric oxygen vacancies is high.

BRIEF DESCRIPTION OF THE FIGURES

These and other features, aspects, and advantages of the present disclosure will become better understood when the following detailed description is read with reference to the accompanying drawings, wherein:

FIG. 2A—6 hours, 2 μm;

FIG. 2B—6 hours, 500 nm; FIG. 2C—24 hours, 2 μm; FIG. 2D—24 hours, 500 nm; FIG. 2E—48 hours, 2 μm; FIG. 2F—48 hours, 500 nm;

FIG. 3A is a transmission electron microscopy (TEM) image of Cu; and FIG. 3B is a high-resolution transmission electron microscopy (HRTEM) image of CuW;

FIG. 7 depicts x-ray powder diffraction (XRD) patterns of the various CuW nanospheres;

FIG. 11 depicts the results of a stability test on Mo/H—CuW and H—CuW.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DETAILED DESCRIPTION

According to an aspect of the present disclosure, there is provided a method of making a $CuWO_4$ hollow nanosphere, including forming a $CuWO_4$ hollow nanosphere by a hydrothermal process followed by a thermal treatment; plasma-treating the $CuWO_4$ hollow nanosphere with a plasma to introduce oxygen vacancies, and introducing Mo clusters adjacent to the oxygen vacancies. In an example, the hydrothermal process is a facile hydrothermal process that includes mixing a copper source, a tungsten source, and an adjuvant to form a solution; heating the solution to form a precursor precipitate; and drying the precursor precipitate. In another example, the thermal treatment includes annealing the precursor precipitate to form a $CuWO_4$ hollow nanosphere.

Synthesis of a $CuWO_4$ Hollow Nanosphere

Figure 1:
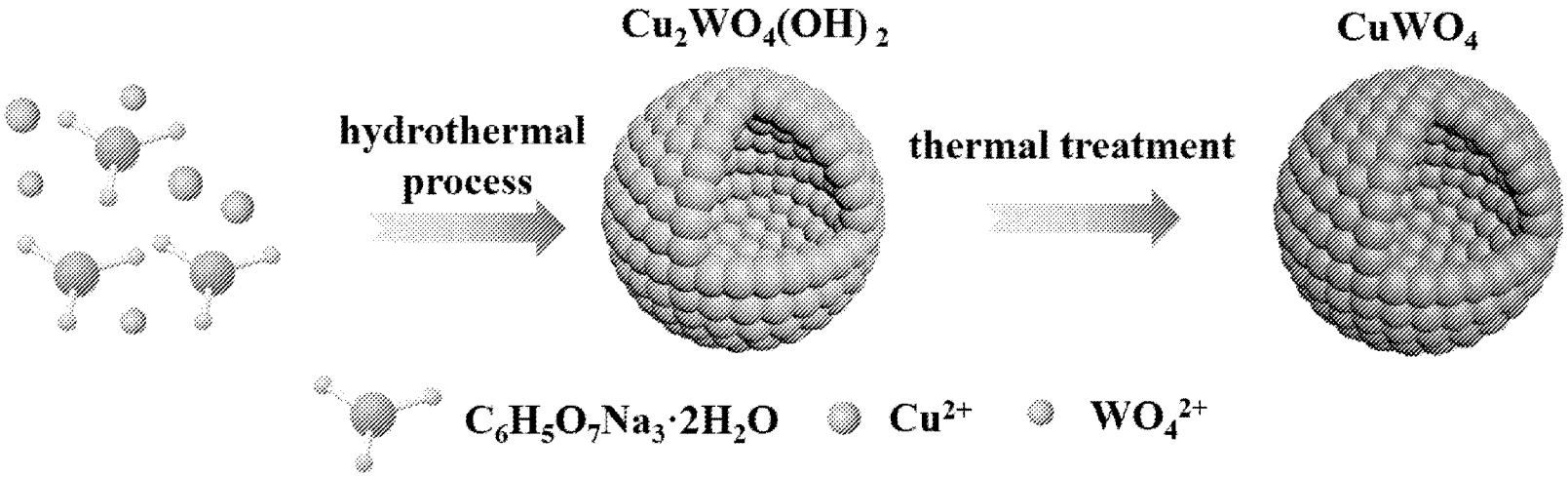
FIG. 1 is a schematic illustration of a method of making a hollow nanosphere.

The $CuWO_4$ hollow nanosphere may be synthesized by a facile hydrothermal method followed by a thermal treatment, as shown in FIG. 1. In an example, the facile hydrothermal method may include forming a solution including a copper source, a tungsten source, and an adjuvant; heating the solution to form a precursor precipitate; and collecting and washing the precursor precipitate.

In another example, forming a solution may include mixing the copper source, the tungsten source, and the adjuvant in an aqueous liquid to form a homogeneous solution. In yet another example, forming a solution may include dissolving the copper source and the tungsten source in an aqueous liquid to form a homogeneous solution, followed by the addition of the adjuvant. In still another example, the aqueous liquid may be deionized water. In a further example, the copper source may be a water-soluble copper salt. Non-limiting examples of water-soluble copper salts include copper chloride dihydrate ($CuCl_2 \cdot 2H_2O$) and copper nitrate hydrate ($Cu(NO_3)_2 \cdot 3H_2O$). In yet a further example, the tungsten source may be a water-soluble tungsten salt. Non-limiting examples of water-soluble tungsten salts include sodium tungstate dihydrate ($Na_2WO_4 \cdot 2H_2O$) and ammonium tungstate hydrate ($(NH_4)_6W_7O_{24} \cdot 6H_2O$). In still a further example, the adjuvant may be sodium citrate dihydrate ($C_6H_5O_7Na_3 \cdot 2H_2O$). The adjuvant may be used to control the growth of the hollow nanosphere structures. In another further example, the ratio of copper source:adjuvant:tungsten source may be in a range of about 1:1:0.5 to about 1:1:1, including all ranges and subranges therein, e.g., about 1:1:0.5 to about 1:1:0.6, about 1:1:0.6 to about 1:1:0.7, about 1:1:0.7 to about 1:1:0.8, about 1:1:0.8 to about 1:1:0.9, about 1:1:0.9 to about 1:1:1, etc.

In another example, heating the solution to form a precursor precipitate may include heating the solution to a first temperature in a range of about 160° C. to about 180° C., including all ranges and subranges therein, e.g., about 160° C. to about 170° C., about 170° C. to about 180° C., about 160° C. to about 165° C., about 165° C. to about 170° C., about 170° C. to about 175° C., about 175° C. to about 180° C., etc. In yet another example, heating the solution to form a precursor precipitate may include heating the solution for about 22 hours to about 26 hours, including all ranges and subranges therein, e.g., about 22 hours to about 24 hours, about 24 hours to about 26 hours, about 22 hours to about 23 hours, about 23 hours to about 24 hours, about 24 hours to about 25 hours, about 25 hours to about 26 hours, about 22 hours to about 22.5 hours, about 22.5 hours to about 23 hours, about 23 hours to about 23.5 hours, about 23.5 hours to about 24 hours, about 24 hours to about 24.5 hours, about 24.5 hours to about 25 hours, about 25 hours to about 25.5 hours, about 25.5 hours to about 26 hours, etc.

In another example, collecting and washing the precursor precipitate may include collecting the precursor precipitate by centrifugation. In yet another example, collecting and washing the precursor precipitate may include washing the precursor precipitate with deionized water and ethanol.

In another example, the thermal treatment may include annealing the precursor precipitate to form a $CuWO_4$ hollow nanosphere. In yet another example, the precipitate precursor is annealed at a temperature in a range of about 350° C. to about 400° C., including all ranges and subranges therein, e.g., about 350° C. to about 360° C., about 360° C. to about 370° C., about 370° C. to about 380° C., about 380° C. to about 390° C., about 390° C. to about 400° C., about 350° C. to about 355° C., about 355° C. to about 360° C., about 360° C. to about 365° C., about 365° C. to about 370° C., about 370° C. to about 375° C., about 375° C. to about 380° C., about 380° C. to about 385° C., about 385° C. to about 390° C., about 390° C. to about 395° C., about 395° C. to about 400° C., etc.

For example, the facile hydrothermal method may include dissolving a copper source and a tungsten source in deionized water to form a homogeneous solution, followed by the addition of an adjuvant. The solution may then be heated at a temperature in a range of about 160° C. to about 180° C. for about 22 hours to about 26 hours, resulting in a precipitate of the $Cu_2WO_4(OH)_2$ precursor. The precursor precipitate may be collected by centrifugation and washed with deionized water and ethanol. Then the precursor precipitate may be subjected to a thermal treatment to yield a $CuWO_4$ hollow nanosphere. For example, the precursor precipitate may be annealed at a temperature in a range of about 350° C. to about 450° C. for about 1 hour to about 2 hours in air atmosphere to form a $CuWO_4$ hollow nanosphere.

Figure 2A:
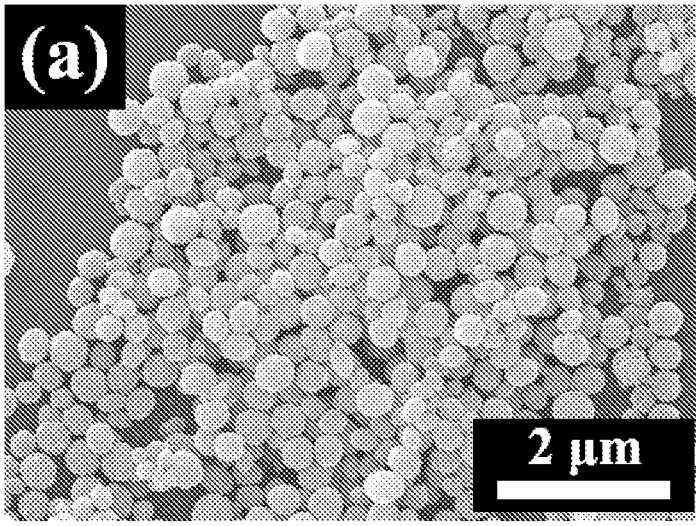
FIGS. 2A-2F are scanning electron microscopy (SEM) images with various magnifications of $CuWO_4$ prepared by different hydrothermal durations.
Figure 2B:
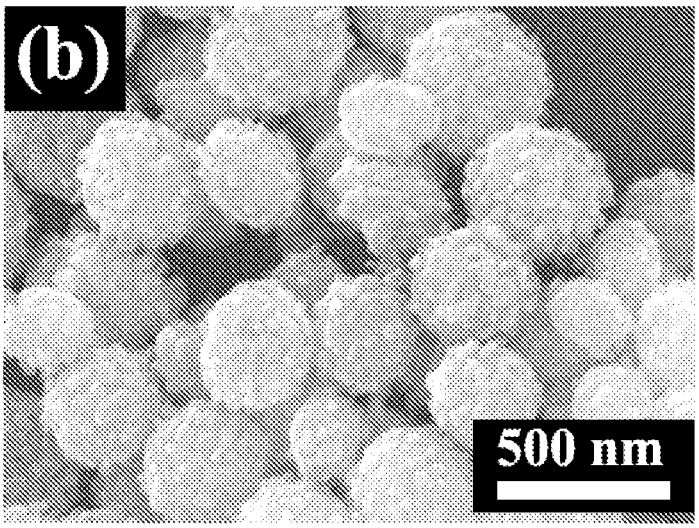
Figure 2C:
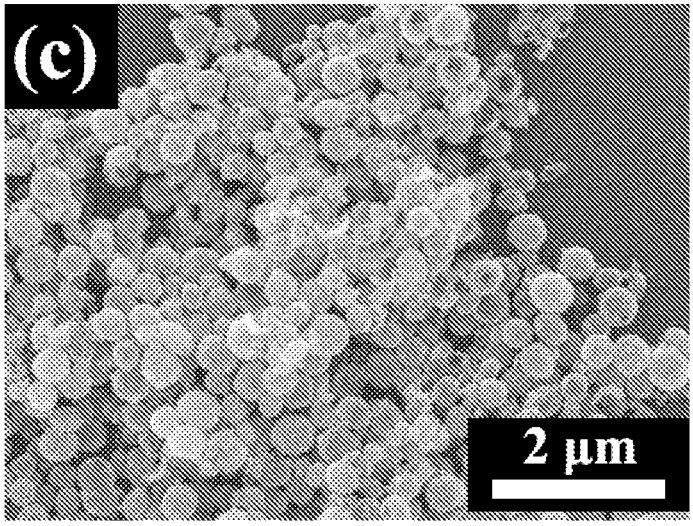
Figure 2D:
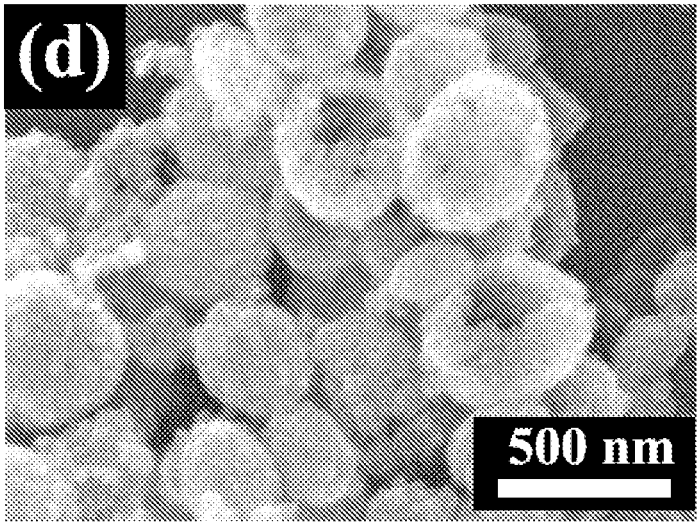
Figure 2E:
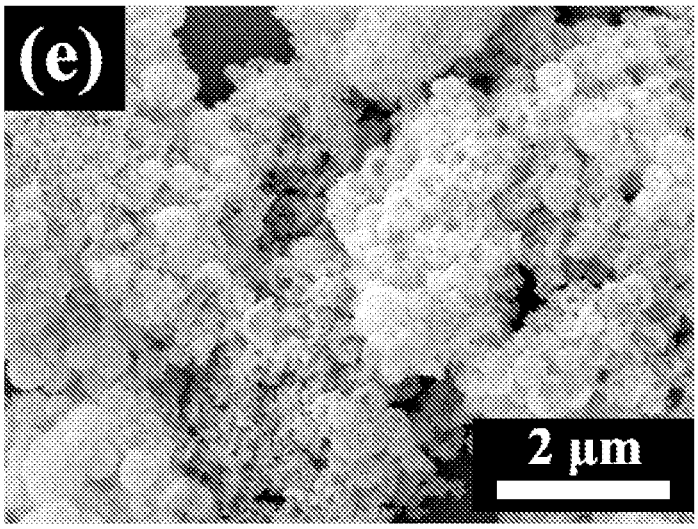
Figure 2F:
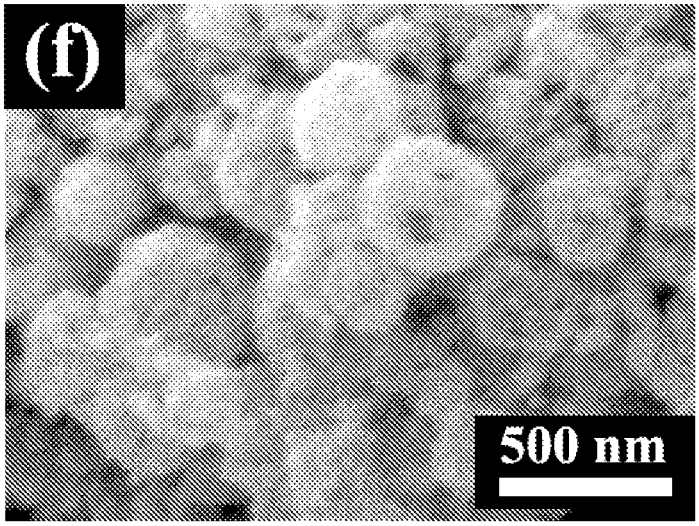

The morphology of $CuWO_4$ may be controlled by varying the duration of the hydrothermal process. In an example, the hydrothermal process may occur for about 4 hours to about 8 hours, including all ranges and subranges therein, e.g., about 4 hours to about 6 hours, about 6 hours to about 8 hours, about 4 hours to about 5 hours, about 5 hours to about 6 hours, about 6 hours to about 7 hours, about 7 hours to about 8 hours, about 4 hours to about 4.5 hours, about 4.5 hours to about 5 hours, about 5 hours to about 5.5 hours, about 5.5 hours to about 6 hours, about 6 hours to about 6.5 hours, about 6.5 hours to about 7 hours, about 7.5 hours to about 8 hours, etc., to form a solid $CuWO_4$ nanosphere with an average diameter in a range of about 216 nm to about 394 nm, including all ranges and subranges therein, e.g., about 216 nm to about 300 nm, about 300 nm to about 394 nm, about 216 nm to about 250 nm, about 250 nm to about 300 nm, about 300 nm to about 350 nm, about 350 nm to about 394 nm, etc., (examples shown in FIG. 2A and FIG. 2B). In another example, the hydrothermal process may occur for about 22 hours to about 26 hours, including all ranges and subranges therein, e.g., about 22 hours to about 26 hours, including all ranges and subranges therein, e.g., about 22 hours to about 24 hours, about 24 hours to about 26 hours, about 22 hours to about 23 hours, about 23 hours to about 24 hours, about 24 hours to about 25 hours, about 25 hours to about 26 hours, about 22 hours to about 22.5 hours, about 22.5 hours to about 23 hours, about 23 hours to about 23.5 hours, about 23.5 hours to about 24 hours, about 24 hours to about 24.5 hours, about 24.5 hours to about 25 hours, about 25 hours to about 25.5 hours, about 25.5 hours to about 26 hours, etc. to form hollow $CuWO_4$ nanospheres with an average diameter in a range of about 300 nm to about 450 nm, including all ranges and subranges therein, e.g., about 300 nm to about 350 nm, about 350 nm to about 400 nm, about 400 nm to about 450 nm, about 300 nm to about 325 nm, about 325 nm to about 350 nm, about 350 nm to about 375 nm, about 375 nm to about 400 nm, about 400 nm to about 425 nm, about 425 nm to about 450 nm, etc. (examples shown in FIG. 2C and FIG. 2D). Moreover, if the hydrothermal process occurs for about 46 hours to about 50 hours, including all ranges and subranges therein, e.g., about 46 hours to about 48 hours, about 48 hours to about 50 hours, about 46 hours to about 47 hours, about 47 hours to about 48 hours, about 48 hours to about 49 hours, about 49 hours to about 50 hours, etc., the $CuWO_4$ hollow nanospheres may begin to break, resulting in an average diameter in a range of about 303 nm to about 441 nm, including all ranges and subranges therein, e.g., about 303 nm to about 350 nm, about 350 nm to about 400 nm, about 400 nm to about 441 nm, etc., (examples shown in FIG. 2E and FIG. 2F).

In an example, the hydrothermal process occurs for about 6 hours and results in $CuWO_4$ solid nanospheres with an average diameter of about 305.7 nm. In another example, the hydrothermal process occurs for about 24 hours and results in $CuWO_4$ hollow nanospheres with an average diameter of about 373.6 nm. In yet another example, the hydrothermal process occurs for about 48 hours and results in $CuWO_4$ broken nanospheres with an average diameter of about 372.2 nm.

Figure 3A:
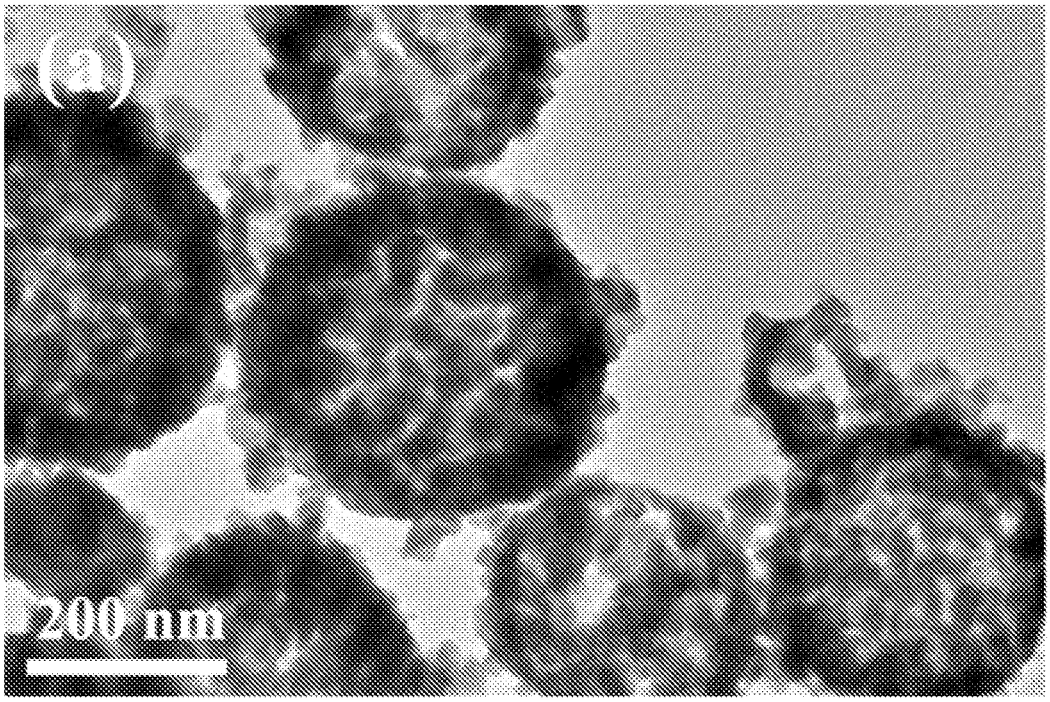
FIG. 3A and FIG. 3B show the hollow structure of $CuWO_4$.
Figure 3B:
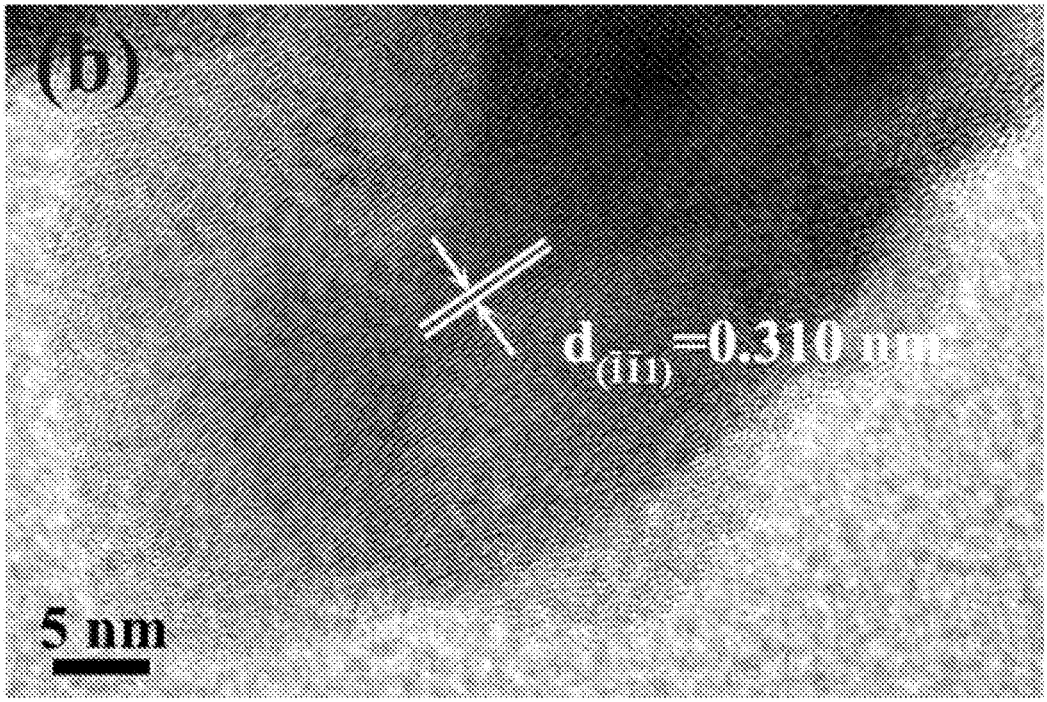

FIG. 3A, which depicts a transmission electron microscopy image of CuW, and FIG. 3B, which depicts a high-resolution transmission electron microscopy image of CuW, show an example of the hollow structure of CuWO4, and the lattice fringes with the interplanar spacings of 0.310 nm correspond to the $(\overline{1}\overline{1}1)$ plane of triclinic $CuWO_4$.

Figure 4A:
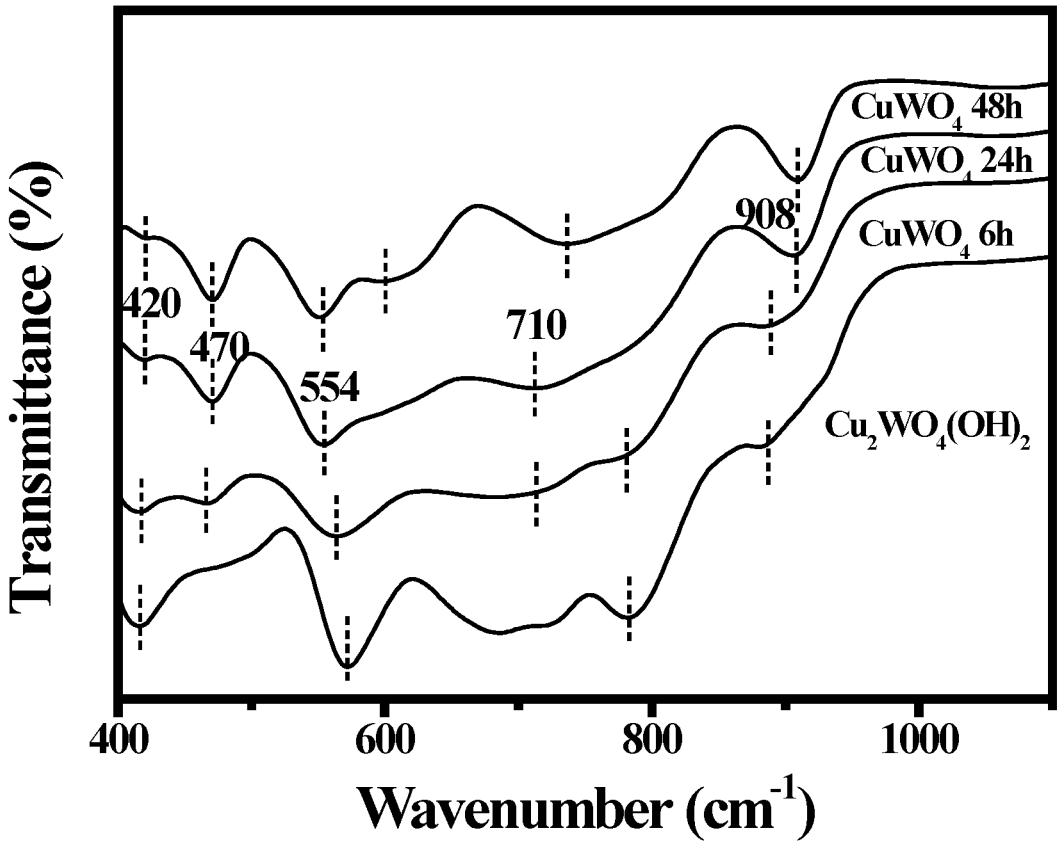
FIG. 4A is a Fourier-transform infrared spectroscopy (FT-IR) spectra of $Cu_2WO_4(OH)_2$ and $CuWO_4$ prepared by different hydrothermal durations.
Figure 4B:
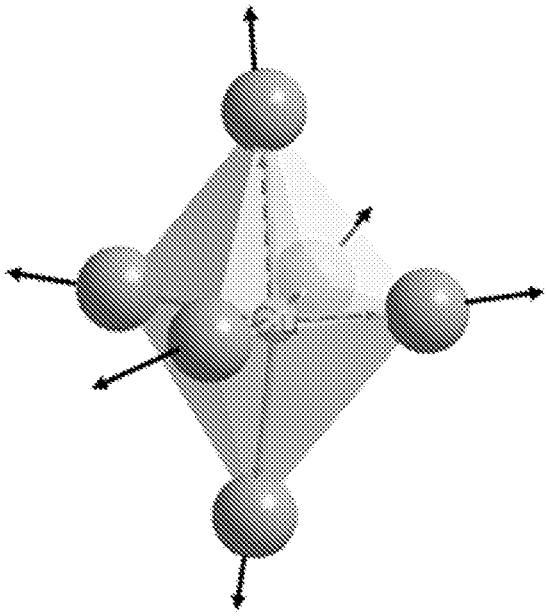
FIG. 4B depicts a typical symmetric and anti-symmetric stretching vibration of (b) O—Cu—O bonds in octahedral $[CuO_6]$ clusters.
Figure 4C:
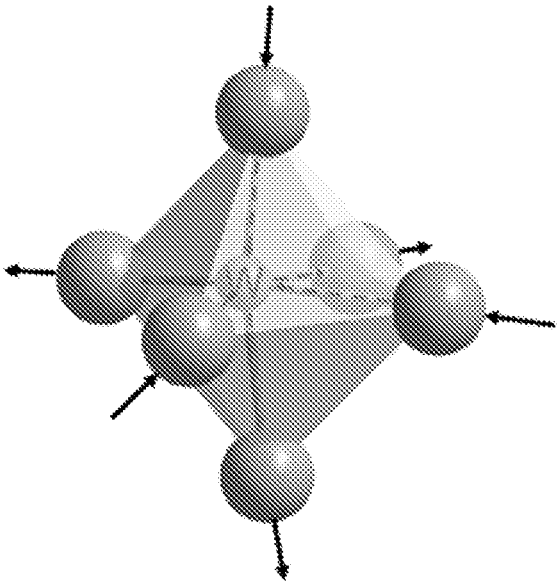
FIG. 4C depicts a typical symmetric and anti-symmetric stretching vibration of (c) O—W—O bonds in octahedral $[WO_6]$ clusters.
Figure 5A:
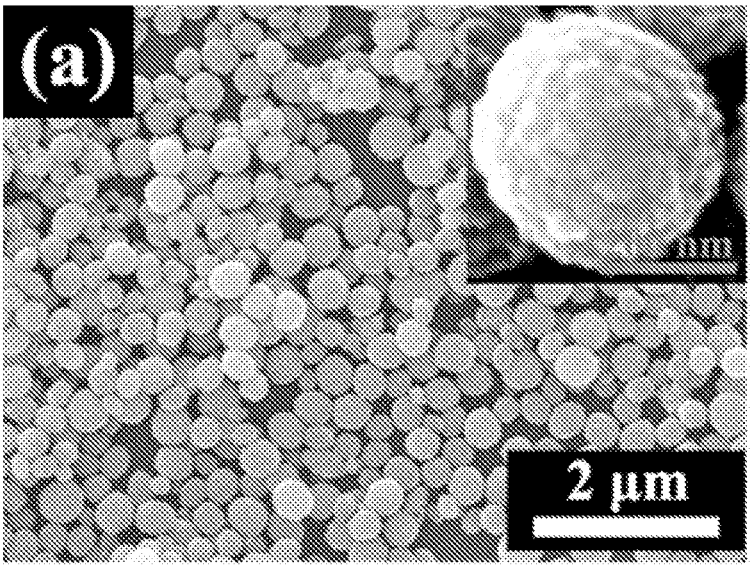
FIGS. 5A-5D are SEM images of L—CuW (FIG. 5A and FIG. 5C) and H—CuW (FIG. 5B and FIG. 5D), where CuW are prepared by different hydrothermal durations of 6 hours (FIG. 5A and FIG. 5B) and 24 hours (FIG. 5C and FIG. 5D)
Figure 5B:
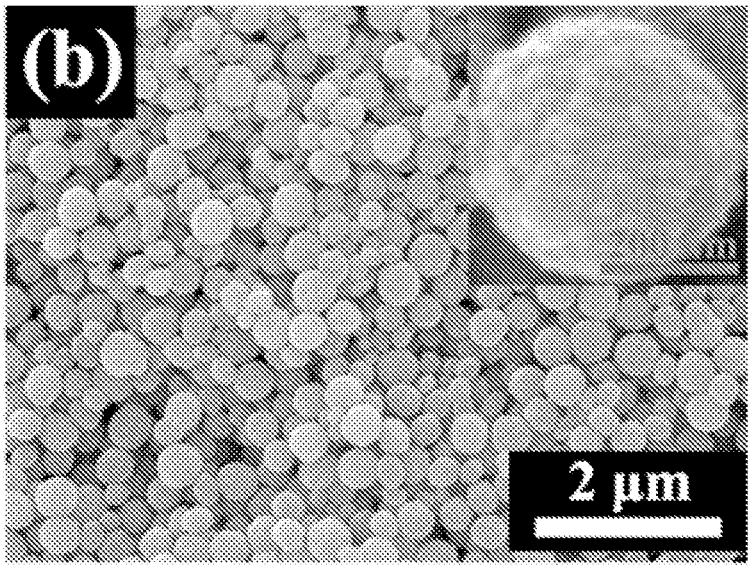
Figure 5C:
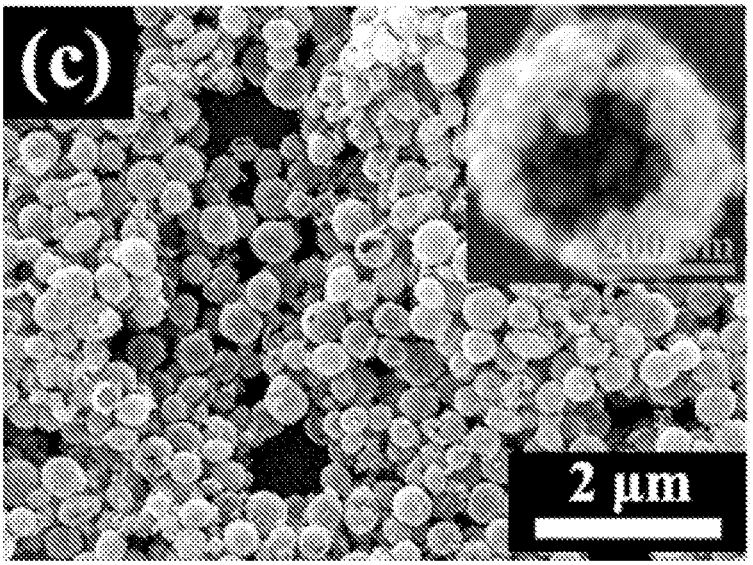
Figure 5D:
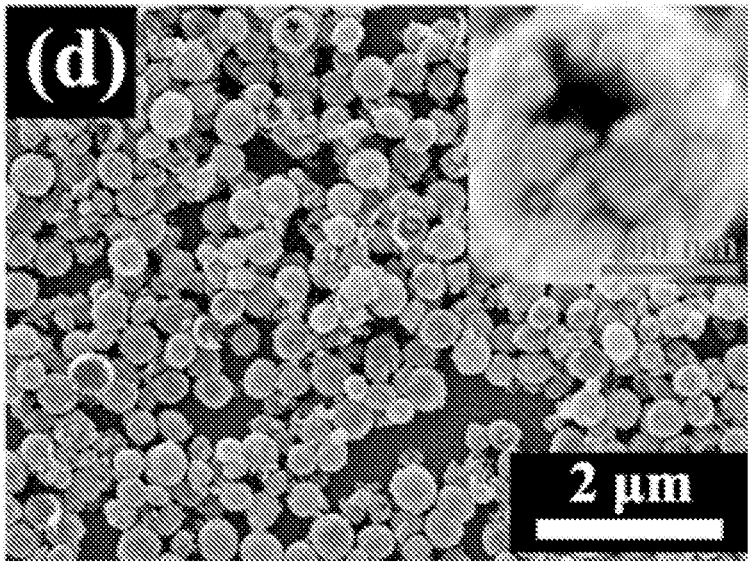

FIG. 4A, which depicts a Fourier-transform infrared spectroscopy spectra, shows an example of the transformation from $Cu_2WO_4(OH)_2$ precursor to $CuWO_4$ during the thermal treatment. The band at approximately 470 $cm^{-1}$ represents the symmetric stretching vibrations of $[CuO_6]$ and the other peaks (at approximately 908, 710, 554, and 420 $cm^{-1}$) represent the symmetric stretching, anti-symmetric stretching, interactive symmetric stretching and symmetric bending vibrations of the distorted $[WO_6]$ clusters. This information demonstrates the distortions on octahedral $[CuO_6]$ and $[WO_6]$ clusters and suggests the degree of asymmetry Cu—$O_v$—W sites.

Synthesis of $CuWO_4$ Hollow Nanospheres with Different Concentrations of Ov

Oxygen vacancies ($O_v$) are generally considered active sites, which are important factors dictating the activity of electrocatalysts, and give rise to an electron-rich surface that lowers the adsorption/activation energy of the target molecule. Symmetric $O_v$ represents the site chained with the symmetric coordinated cations, whereas the linkage terminals of ones constituted by different kinds of cations are called asymmetric $O_v$. Asymmetric $O_v$ keeps a dynamic balance between the adsorption and the desorption of oxygen species.

Plasma atmosphere treatment may be used to introduce various concentrations of $O_v$ into $CuWO_4$. In an example, the $CuWO_4$ hollow nanosphere may be exposed to a plasma with RF power of about 200 W and gas flow in a range of about 10 sccm to about 20 sccm, including all ranges and subranges therein, e.g., about 10 sccm to about 15 sccm, about 15 sccm to about 20 sccm, about 10 sccm to about 12 sccm, about 12 sccm to about 14 sccm, about 14 sccm to about 16 sccm, about 16 sccm to about 18 sccm, about 18 sccm to about 20 sccm, etc. In another example, $CuWO_4$ hollow nanospheres may be exposed to a plasma for about 300 seconds to about 600 seconds, including all ranges and subranges therein, e.g., about 300 seconds to about 300 seconds, about 400 seconds to about 500 seconds, about 500 seconds to about 600 seconds, about 300 seconds to about 350 seconds, about 350 seconds to about 400 seconds, about 400 seconds to about 450 seconds, about 450 seconds to about 500 seconds, about 500 seconds to about 550 seconds, about 550 seconds to about 600 seconds, about 300 seconds to about 320 seconds, about 320 seconds to about 340 seconds, about 340 seconds to about 360 seconds, about 360 seconds to about 380 seconds, about 380 seconds to about 400s seconds, about 400 seconds to about 420 seconds, about 420 seconds to about 440 seconds, about 440 seconds to about 460 seconds, about 460 seconds to about 480 seconds, about 480 seconds to about 500 seconds, about 500s seconds to about 520 seconds, about 520 seconds to about 540 seconds, about 540 seconds to about 560 seconds, about 560 seconds to about 580 seconds, about 580 seconds to about 600 seconds, etc. In yet another example, the plasma atmosphere may be Ar or $N_2$. When Ar or $N_2$ plasma bombards the surface of $CuWO_4$, the internal energy of metastable Ar-plasma may be transferred to the surface atoms, which leads to the removal of the relatively light oxygen atoms and results in $CuWO_4$ with a high concentration of $O_v$ (H—CuW). In a further example, the plasma atmosphere may be $O_2$. The $O_2$ plasma-induced oxygen ions or radical groups may be trapped inside $CuWO_4$ to fill $O_v$, resulting in $CuWO_4$ with a low concentration of $O_v$ (L—CuW).

In an example, different concentrations of oxygen vacancies may be introduced by annealing the $CuWO_4$ hollow nanosphere in hydrogen atmosphere at a temperature of about 300° C. for about 20 minutes to about 60 minutes, including all ranges and subranges therein, e.g., about 20 minutes to about 40 minutes, about 40 minutes to about 60 minutes, about 20 minutes to about 30 minutes, about 30 minutes to about 40 minutes, about 40 minutes to about 50 minutes, about 50 minutes to about 60 minutes, etc. In an example, the hydrogen atmosphere may be $H_2$/Ar 5% vol.

Every O atom may be linked to at least one W atom and one Cu atom in $CuWO_4$, thus the oxygen vacancies in $CuWO_4$ may build a Cu—$O_v$—W asymmetric structure, in which the two surrounding cations with different electronegativity own opposite influences toward the stability of oxygen species. Asymmetric $O_v$ balances the adsorption and desorption of oxygen species, thus enhancing the performance of $NO_3$RR.

Plasma atmosphere treatment did not affect the morphology of the $CuWO_4$ nanospheres, as indicated by examples shown in FIGS. 5A through 5D. For example, $CuWO_4$ solid nanospheres (e.g., hydrothermal method duration of about 6 hours) treated with $O_2$ plasma (FIG. 5A) or Ar plasma (FIG. 5B) retain their solid nanosphere morphology. In another example, $CuWO_4$ hollow nanospheres (e.g., hydrothermal method duration of about 24 hours) treated with $O_2$ plasma (FIG. 5C) or Ar plasma (FIG. 5D) retain their solid or hollow nanosphere morphology.

Figure 6A:
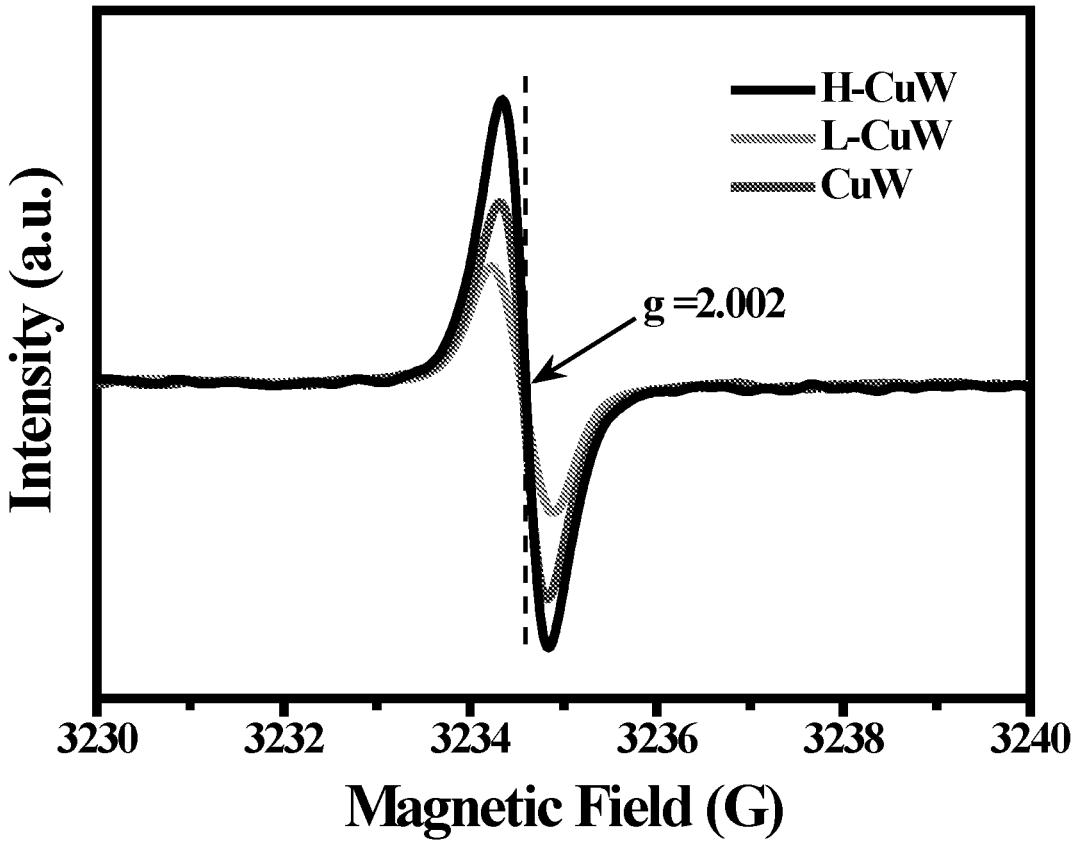
FIG. 6A is an electron paramagnetic resonance (EPR) spectrum of L—CuW, CuW, and H—CuW.

$O_v$ concentrations were assessed by electron paramagnetic resonance (EPR) spectroscopy, x-ray photoelectron spectroscopy (XPS), and Raman spectroscopy. Signals in a range of about g=2.001 to about g=2.003, including all ranges and subranges therein, e.g., about 2.001 to about 2.002, about 2.002 to about 2.003, etc., on an EPR spectrum may suggest the presence of oxygen vacancies. In an example, a signal at about g=2.002 on the EPR spectra of L—CuW, CuW, and H—CuW, suggests the presence of oxygen vacancies (FIG. 6A).

Figure 6B:
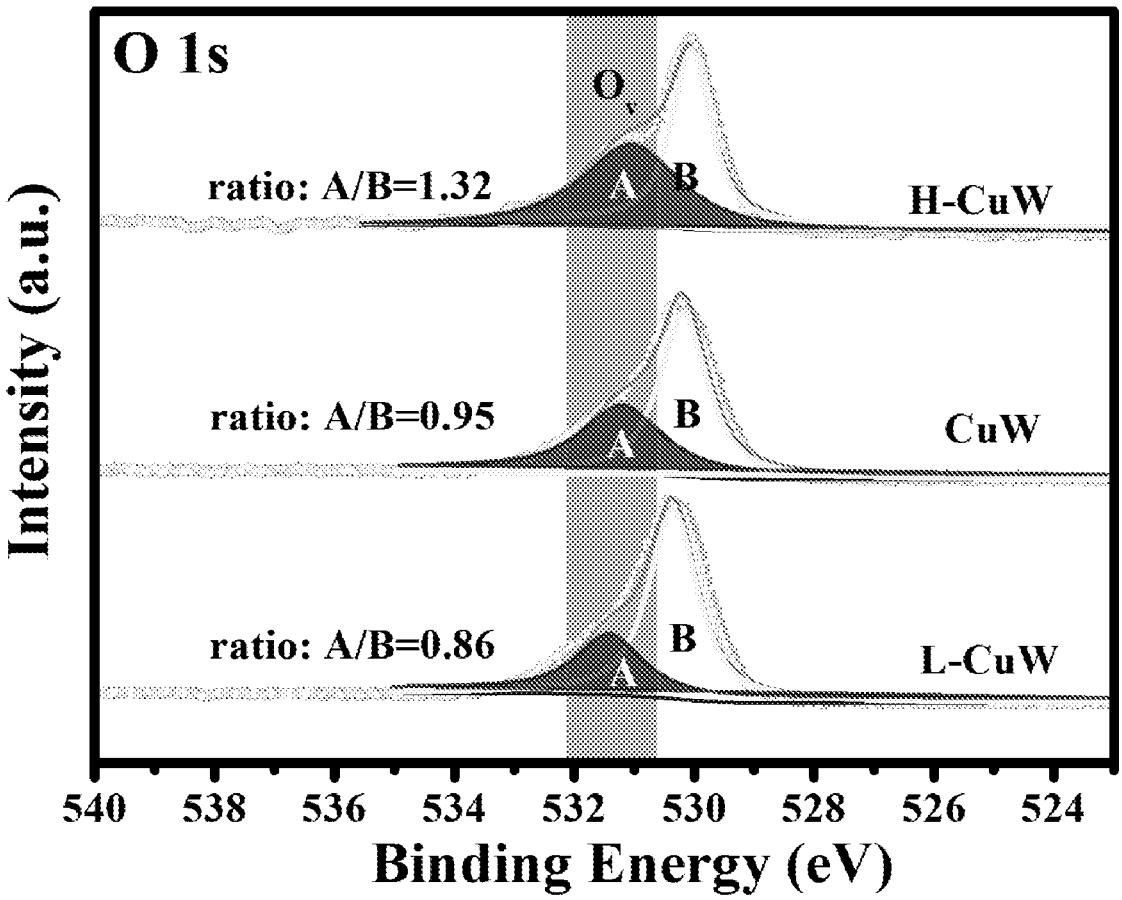
FIG. 6B is an O 1s x-ray photoelectron spectroscopy (XPS) spectrum of L—CuW, CuW, and H—CuW.

Furthermore, on a high-resolution XPS spectra of O 1s, a peak in a range of about 530.1 eV to about 530.3 eV, including all ranges and subranges therein, e.g., about 530.1 eV to about 530.2 eV, about 530.2 eV to about 530.3 eV, etc., may indicate lattice oxygen and a peak in a range of about 531.1 eV to about 531.3 eV, including all ranges and subranges therein, e.g., about 531.1 eV to about 531.2 eV, about 531.2 eV to about 531.3 eV, etc., may indicate oxygen atoms next to $O_v$. In an example, a peak at about 530.2 eV on the high-resolution XPS spectra of L—CuW, CuW, and H—CuW, may indicate lattice oxygen (B in FIG. 6B). In another example, a peak at about 531.2 eV on the high-resolution XPS spectra of L—CuW, CuW, and H—CuW, may indicate oxygem atoms next to Ov (A in FIG. 6B).

A higher A/B ratio suggests a higher concentration of $O_v$ upon the bombardment of plasma on the surface of the $CuWO_4$ nanospheres. For example, H—CuW has a higher A/B ratio compared to CuW and L—CuW, which may suggest a higher concentration of $O_v$ upon Ar plasma treatment compared to no treatment and $O_2$ treatment.

Figure 6C:
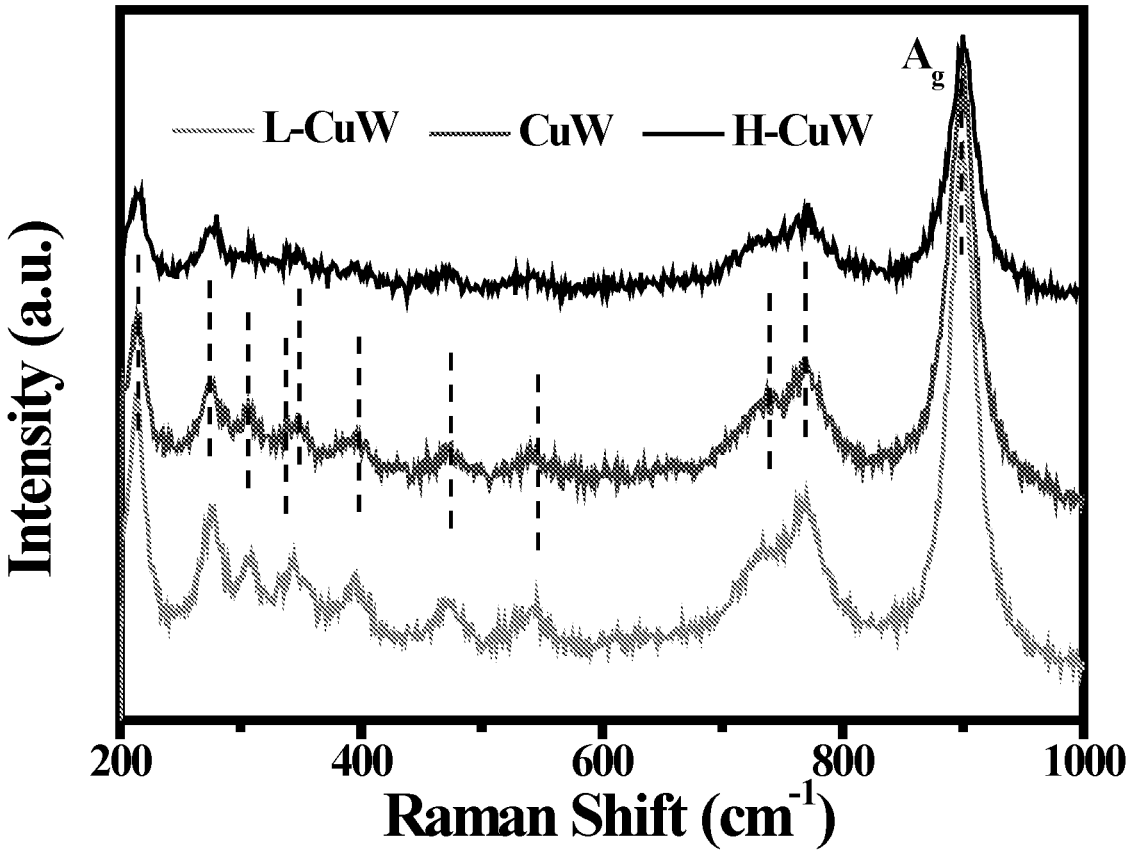
FIG. 6C is a Raman spectrum of L—CuW, CuW, and H—CuW.

FIG. 6C shows example Raman spectra for L—CuW, CuW, and H—CuW, and the Raman bands are assigned to the Raman-active vibrational modes (Ag) of triclinic $CuWO_4$. The Raman bands of H—CuW are weaker and broader compared to CuW and L—CuW, which may indicate a decrease of (O—Cu—O)/(O—W—O) bonds and the generation of more $O_v$ in CuW. Therefore, plasma atmosphere treatment using Ar plasma results in a higher concentration of $O_v$ compared to using $O_2$, which removes the $O_v$.

Synthesis of a $CuWO_4$ Hollow Nanosphere with Mo Clusters

Transition metal clusters such as polyoxometalates (POMs), with bridged metal-metal interactions, can minimize the distance between single-atom centers, thereby improving the intrinsic activity and stability compared to single-atom catalyst (SACs) and maximizing the efficiency of metal atoms. Metal clusters may have unoccupied d-orbitals, which can accept multiple electrons, resulting in the modulation of charge transfer when binding to $NO_3^-$.

A Mo source may be introduced into $CuWO_4$ to orientate the Mo cluster adjacent to the $O_v$. The asymmetric $O_v$ may facilitate a dynamic balance between the adsorption and desorption of O in $NO_3^-$. Further, the Mo clusters may promote the protonation process. A synergistic effect between the asymmetric $O_v$ and adjacent Mo clusters may result in $CuWO_4$ hollow nanospheres that exhibit improved $NH_3$ Faradaic efficiency of 94.60±3.75% and yield rate of about 5.84±0.45 mg $h^{-1}$ $mg_{cat.}^{-1}$ at −0.7 V versus RHE.

Introducing Mo clusters into a $CuWO_4$ hollow nanosphere may include dissolving the plasma-treated $CuWO_4$ hollow nanosphere with a Mo source in water to form a solution, evaporating at a temperature in a range of about 80° C. to about 100° C., including all ranges and subranges therein, e.g., about 80° C. to about 90° C., about 90° C. to about 100° C., about 80° C. to about 85° C., about 85° C. to about 90° C., about 90° C. to about 95° C., about 95° C. to about 100° C., etc., for about 8 hours to about 16 hours, including all ranges and subranges therein, e.g., about 8 hours to about 12 hours, about 12 hours to about 16 hours, about 8 hours to about 10 hours, about 10 hours to about 12 hours, about 12 hours to about 16 hours, about 8 hours to about 9 hours, about 9 hours to about 10 hours, about 10 hours to about 11 hours, about 11 hours to about 12 hours, about 12 hours to about 13 hours, about 13 hours to about 14 hours, about 14 hours to about 15 hours, about 15 hours to about 16 hours, etc. to obtain a powder including a plasma-treated $CuWO_4$ hollow nanosphere with Mo cluster inclusions. Introducing Mo clusters may further include annealing the powder at a temperature in a range of about 80° C. to about 100° C., including all ranges and subranges therein, e.g., about 80° C. to about 90° C., about 90° C. to about 100° C., about 80° C. to about 85° C., about 85° C. to about 90° C., about 90° C. to about 95° C., about 95° C. to about 100° C., etc., for about 1 hour to about 2 hours, including all range and subranges therein, e.g., about 1 hour to about 1.5 hours, about 1.5 hours to about 2 hours, about 1 hour to about 1.2 hours, about 1.2 hours to about 1.4 hours, about 1.4 hours to about 1.6 hours, about 1.6 hours to about 1.8 hours, about 1.8 hours to about 2 hours, about 1 hour to about 1.1 hours, about 1.1 hours to about 1.2 hours, about 1.2 hours to about 1.3 hours, about 1.3 hours to about 1.4 hours, about 1.4 hours to about 1.5 hours, about 1.5 hours to about 1.6 hours, about 1.6 hours to about 1.7 hours, about 1.7 hours to about 1.8 hours, about 1.8 hours to about 1.9 hours, about 1.9 hours to about 2 hours, etc., in $H_2$/Ar atmosphere. In an example, the Mo source is a polyoxomolybdate. Non-limiting examples of polyoxomolybdates include ammonium paramolybdate ($(NH_4)_6Mo_7O_{24}\cdot 4H_2O$), ammonium octamolybdate ($(NH_4)_4Mo_8O_{26}$)), and the like. In another example, the annealing occurs at about 100° C. for about 1 hour.

Figure 7:
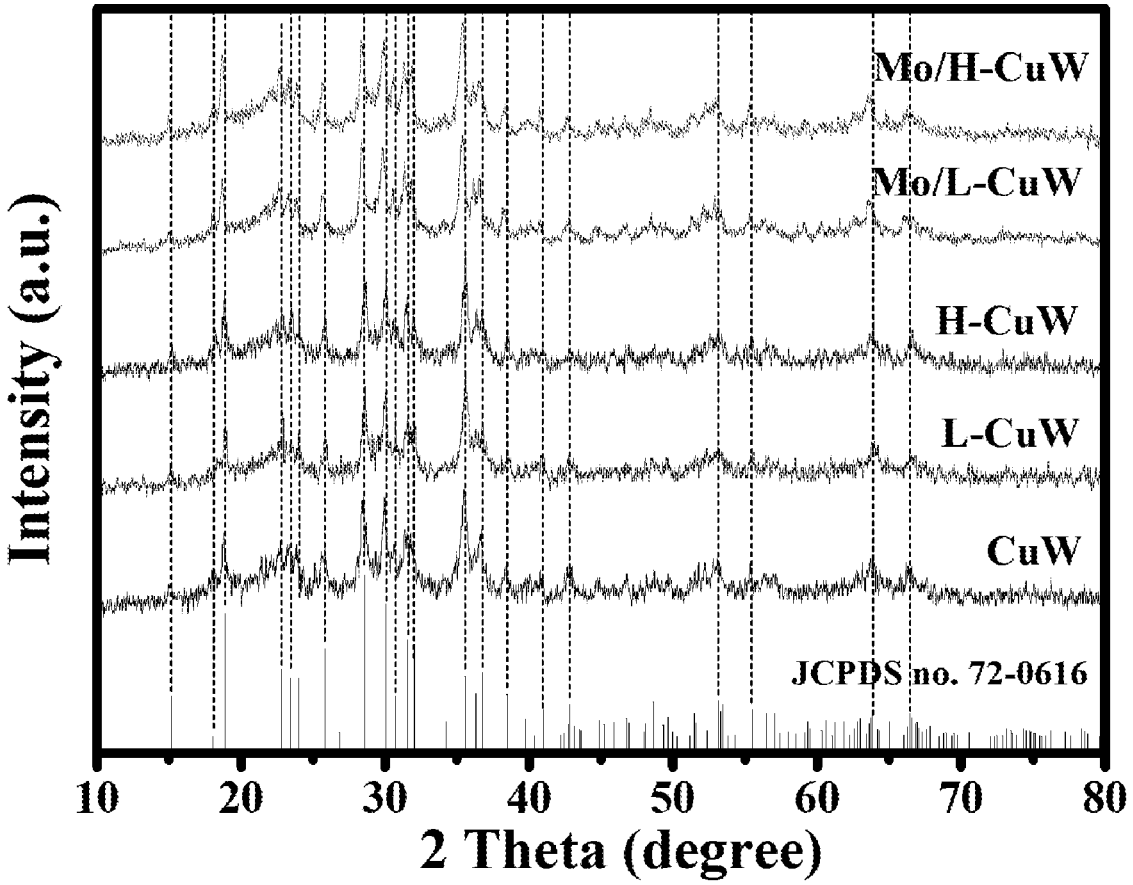

In an example, ammonium paramolybdate was introduced into H—CuW and L—CuW to orientate the Mo cluster next to the $O_v$. Then, the oxygen atoms trapped in the vacancy sites were removed through reduction under $H_2$/Ar atmosphere at a low temperature. X-ray powder diffraction (XRD) was performed on all samples, e.g., CuW, L—CuW, H—CuW, Mo/L—CuW, and Mo/H—CuW, (examples shown in FIG. 7) and indicates that each is indexed to triclinic phase $CuWO_4$ (JCPDS no. 72-0616) without any other detectable impurities.

In another example, the $CuWO_4$ hollow nanosphere exhibits a high $NH_3$ Faradaic efficiency of about 94.60±3.75% and yield rate of about 5.84±0.45 mg $h^{-1}$ $mg_{cat.}^{-1}$ at −0.7 V versus RHE.

Figure 8A:
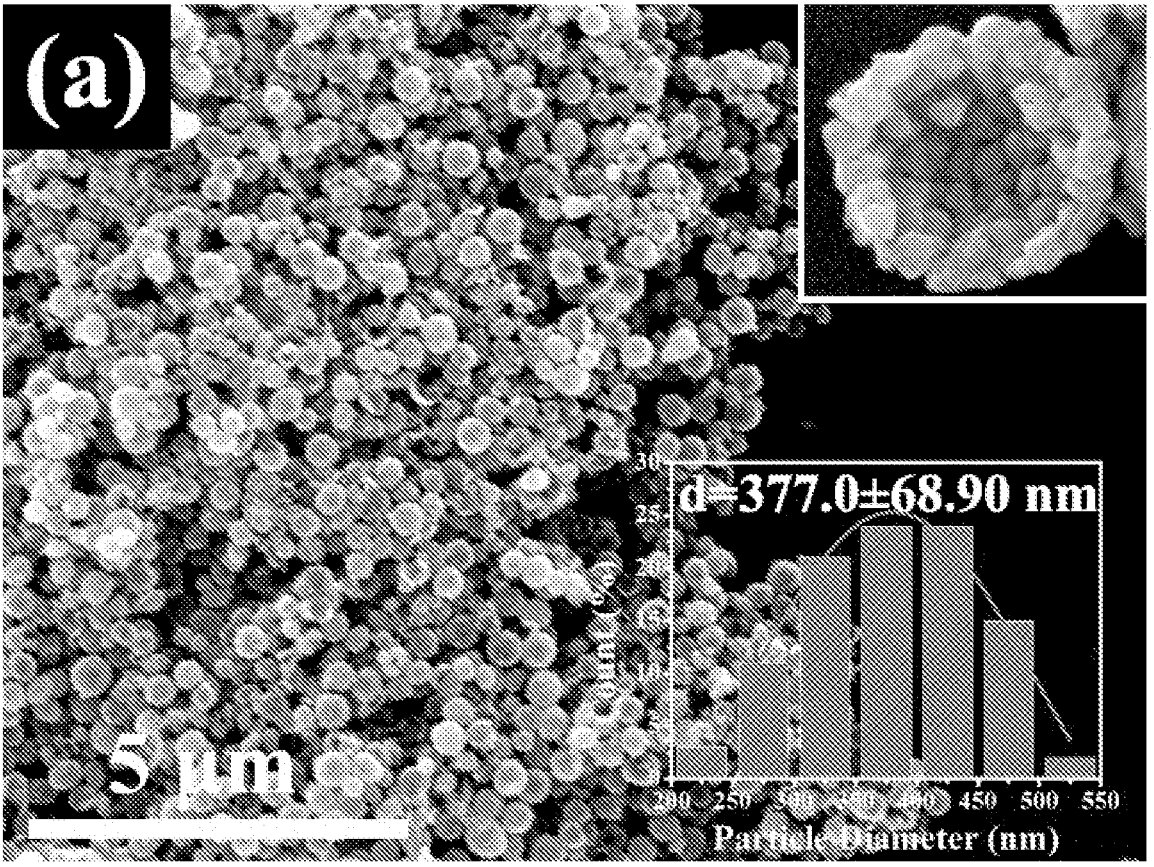
FIG. 8A is an SEM image of Mo/H—CuW, with an inset of an SEM image of single hollow nanosphere and the particle size distribution.
Figure 8B:
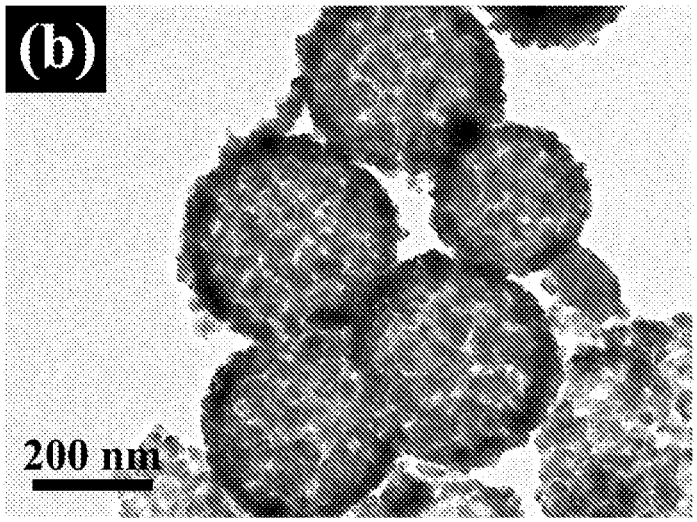
FIG. 8B is a TEM image of Mo/H—CuW.
Figure 8C:
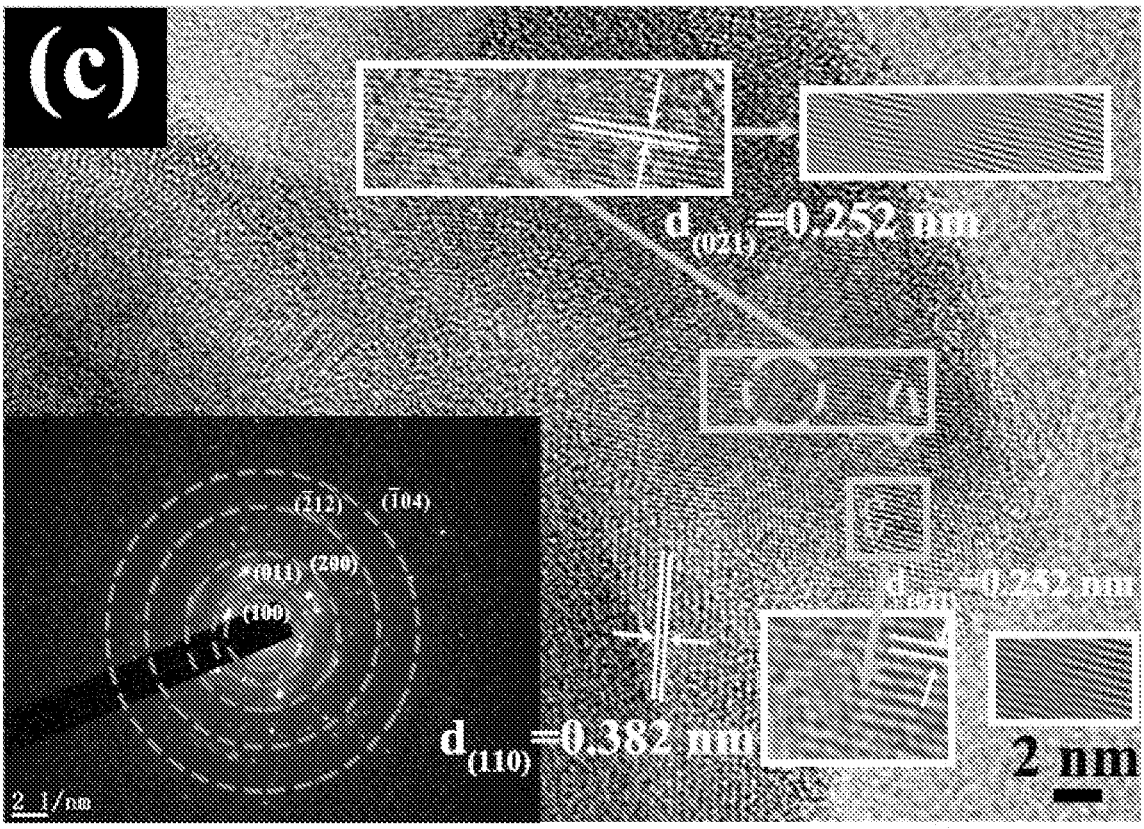
FIG. 8C is an HRTEM image of Mo/H—CuW, with an inset of a selected area diffraction (SAED) pattern of Mo/H—CuW and boxes showing amplified HRTEM images of the corresponding Inverse Fast Fourier Transition (IFFT) images from the circled regions in the inset.

An example of the structure of a Mo/H—CuW hollow nanosphere is shown in FIGS. 8A through 8C. In FIG. 8A, the SEM image depicts examples of Mo/H—CuW as hollow nanospheres, about 377 nm in diameter, with the shell composed of numerous particles. Insets of FIG. 8A depict a single hollow nanosphere and the particle size distribution.

In FIG. 8B, the dark and light boundaries in the TEM image of an example Mo/H—CuW further confirm the hollow structure of the Mo/H—CuW. Generally, hollow-structured nanomaterials such as these have larger specific surface areas than solid ones, thereby enabling the exposure of more active sites and promoting electrocatalytic activity. Further, there are more interfaces among the thin shells because of the numerous small particles of the CuW hollow nanospheres, which provides fast channels for mass transport.

In FIG. 8C, the HRTEM image of an example Mo/H—CuW depicts the lattice fringed with interplanar spacings of about 0.310 nm, about 0.382 nm, and about 0.252 nm, which correspond to the $(\bar{1}\bar{1}1)$ (110) and $(0\bar{2}1)$ planes of triclinic CuW, respectively. Most of the lattice fringes are inconsecutive in the images of Mo/H—CuW. After applying the inverse fast Fourier transform (IFFT) to the selected region, dislocations and distortions were observed, indicating the introduction of abundant oxygen vacancies into the lattice due to the plasma treatment and Mo doping. These oxygen vacancies enable an increase in active sites. In addition, the SAED pattern (inset of FIG. 8C) suggests the characteristics of polycrystalline triclinic CuW.

Figure 9A:
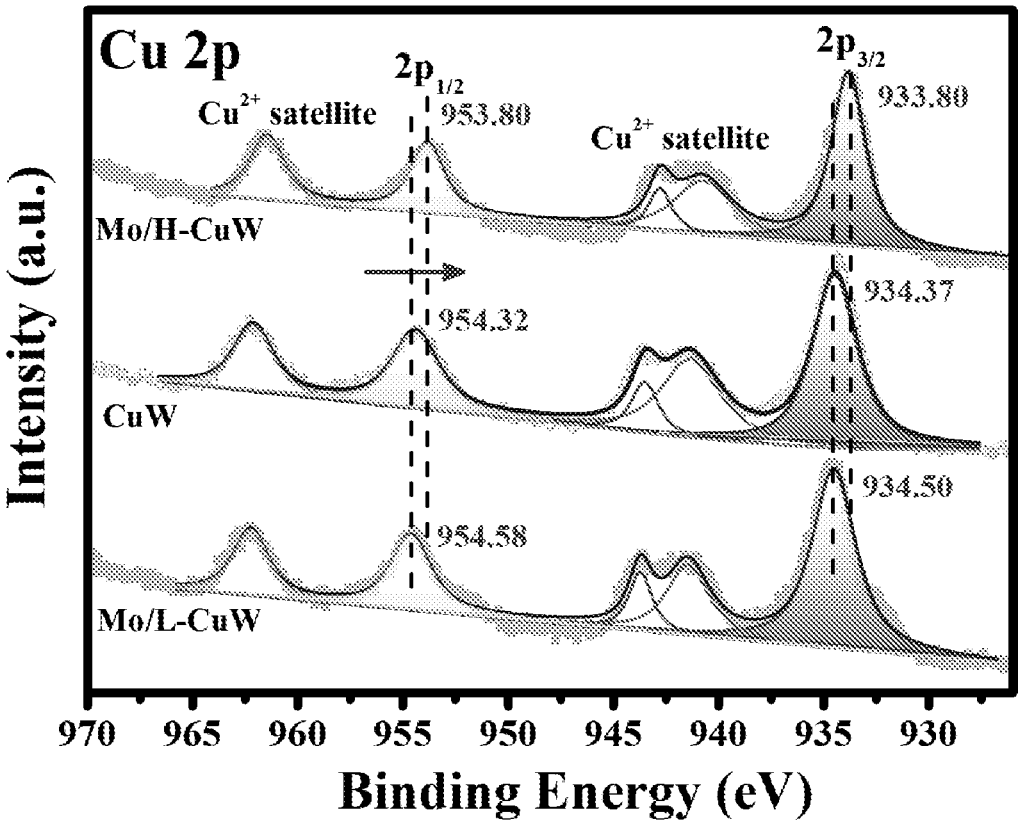
FIG. 9A is a Cu 2p spectra for CuW, Mo/L—CuW, and Mo/H—CuW.

In FIG. 9A, the peaks of Cu $2p_{3/2}$and Cu $2p_{1/2}$ of CuW and Mo/L—CuW locate at similar positions whereas the peaks of Cu $2p_{3/2}$and Cu $2p_{1/2}$ of Mo/H—CuW are shifted to a lower binding energy. This indicates an increase in local electron density of Cu due to delocalized electrons in the $O_v$.

Figure 9B:
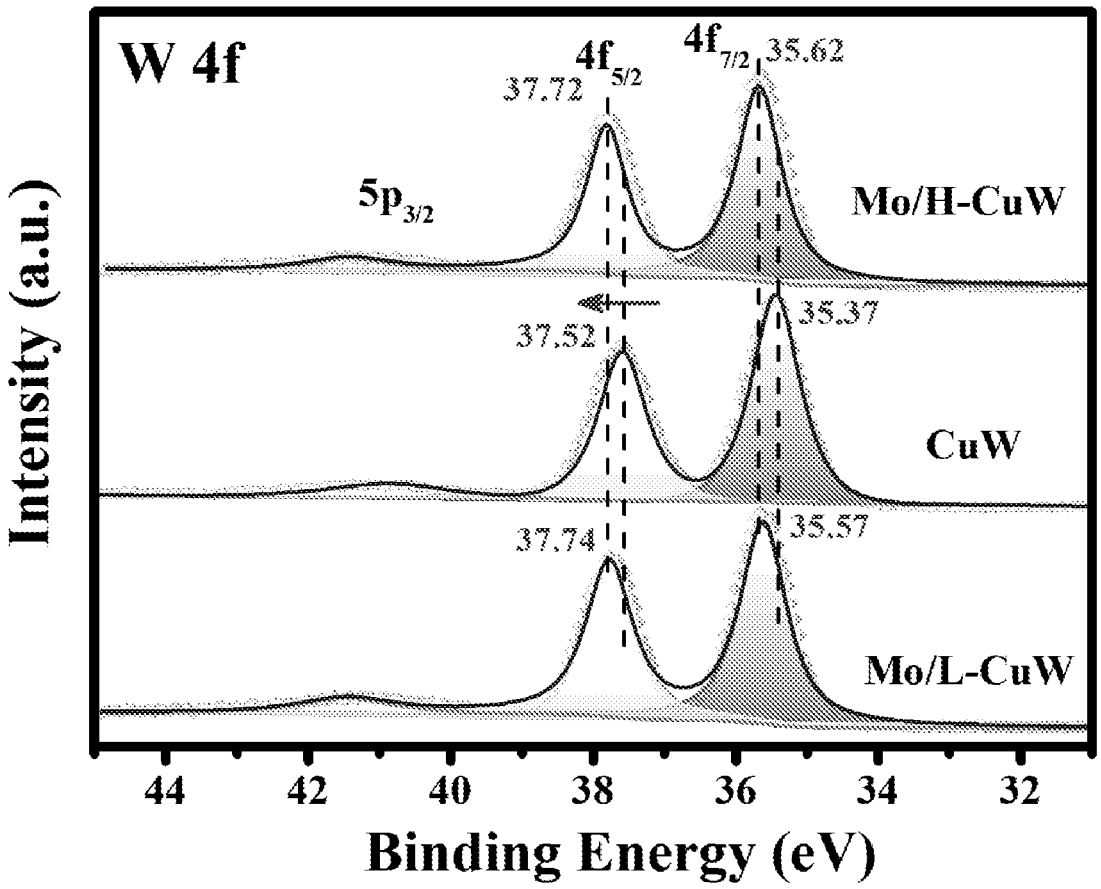
FIG. 9B is a W 4f spectra for CuW, Mo/L—CuW, and Mo/H—CuW.

In FIG. 9B, the peaks of W 4f of Mo/H—CuW shift to higher binding energies compared to CuW and Mo/L—CuW. This demonstrates the electron transfer from W to Mo clusters and the formation of W—O—Mo bonds with the help of Cu—$O_v$—W asymmetric sites. Therefore, the Cu—$O_v$—W asymmetric sites may modulate the local charge distribution and then contribute to polarizing the adsorbed $NO_3^-$ molecules for better activation and surface electrochemical nitrate reduction process.

Figure 9C:
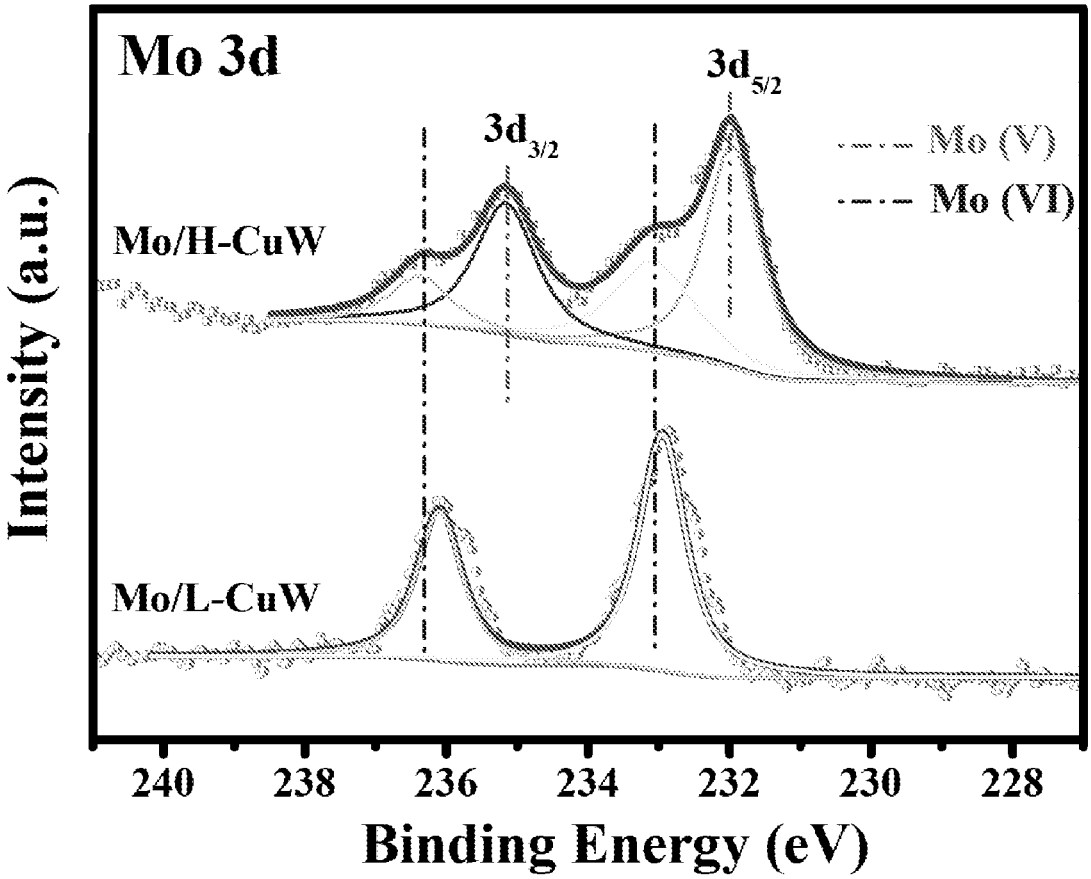
FIG. 9C is a Mo 3d XPS spectra for the Mo/L—CuW and Mo/H—CuW.

In FIG. 9C, for Mo/H—CuW, the deconvoluted peaks at 232.04 eV, 235.16 eV and 233.07 eV, 236.33 eV can be indexed to $Mo^{5+}$ and $Mo^{6+}$, respectively. However, only $Mo^{6+}$ exists in the sample of Mo/L—CuW. As for the VI valence state of Mo in the pristine POMs, the V valence state may result due to the charge transfer along with the W—O—Mo bonds.

Thus, plasma treatment may regulate Cu—$O_v$—W asymmetric sites and Mo clusters are accurately located in $CuWO_4$. The electrochemical activity of the electrocatalyst may be enhanced and stabilized by combining the electron-donating $O_v$ and the electron-compensating Mo cluster.

Figure 10A:
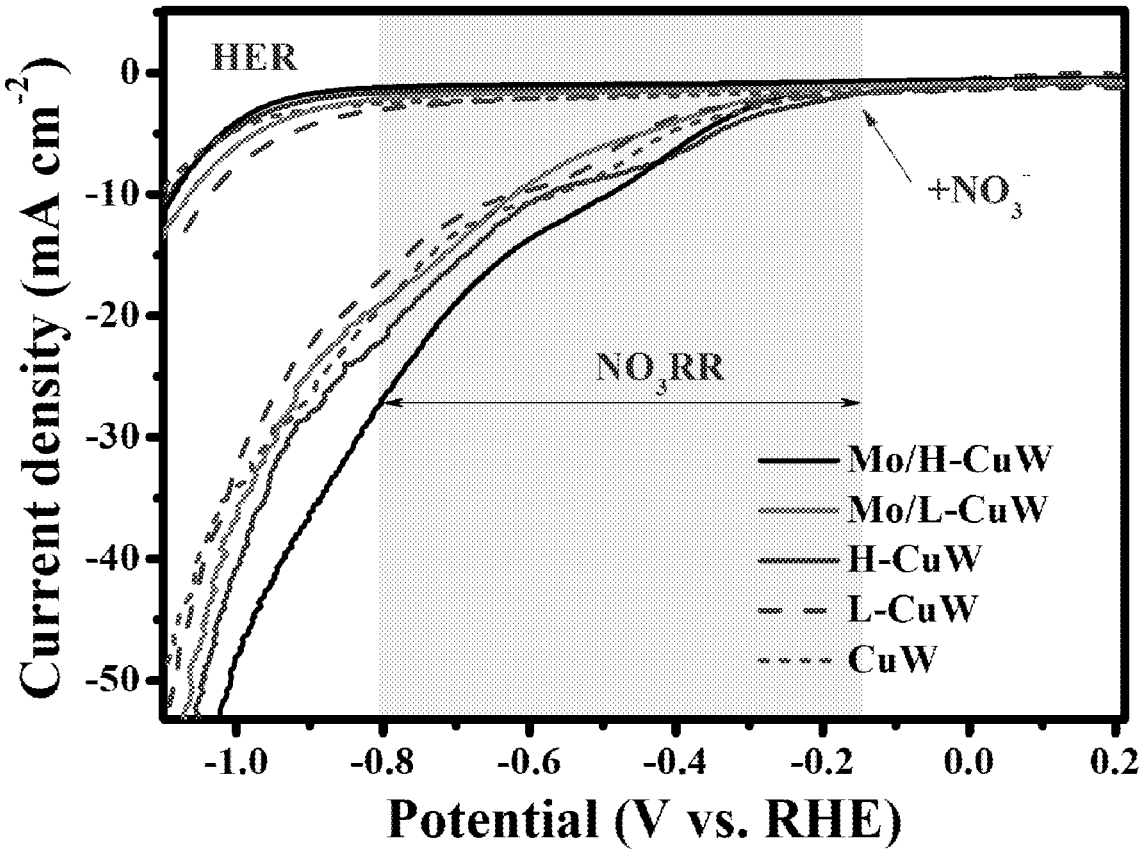
FIG. 10A depicts linear sweep voltammetry (LSV) curves of Mo/H—CuW, Mo/L—CuW, H—CuW, L—CuW, and CuW in 0.5 M $Na_2SO_4$ electrolyte with and without $NO_3^-$ upon a scan rate of 5 mV $s^{-1}$.

The characteristics of a two-compartment H-type electrolytic cell were evaluated under ambient conditions to examine the synergistic effect of $O_v$ and Mo clusters towards $NO_3$RR performance. FIG. 10A depicts a linear sweep voltammetry (LSV) curve for each of CuW, L—CuW, H—CuW, Mo/L—CuW, and Mo/H—CuW in the $Na_2SO_4$ electrolyte with and without $NO_3^-$. The current densities of all the samples for $NO_3$RR are distinctly higher over a wide range of negative potentials than the ones for HER, indicating the electrocatalytic activity for $NO_3^-$ reduction and the poor activity on HER, which enables the high selectivity for $NH_3$ production.

Figure 10B:
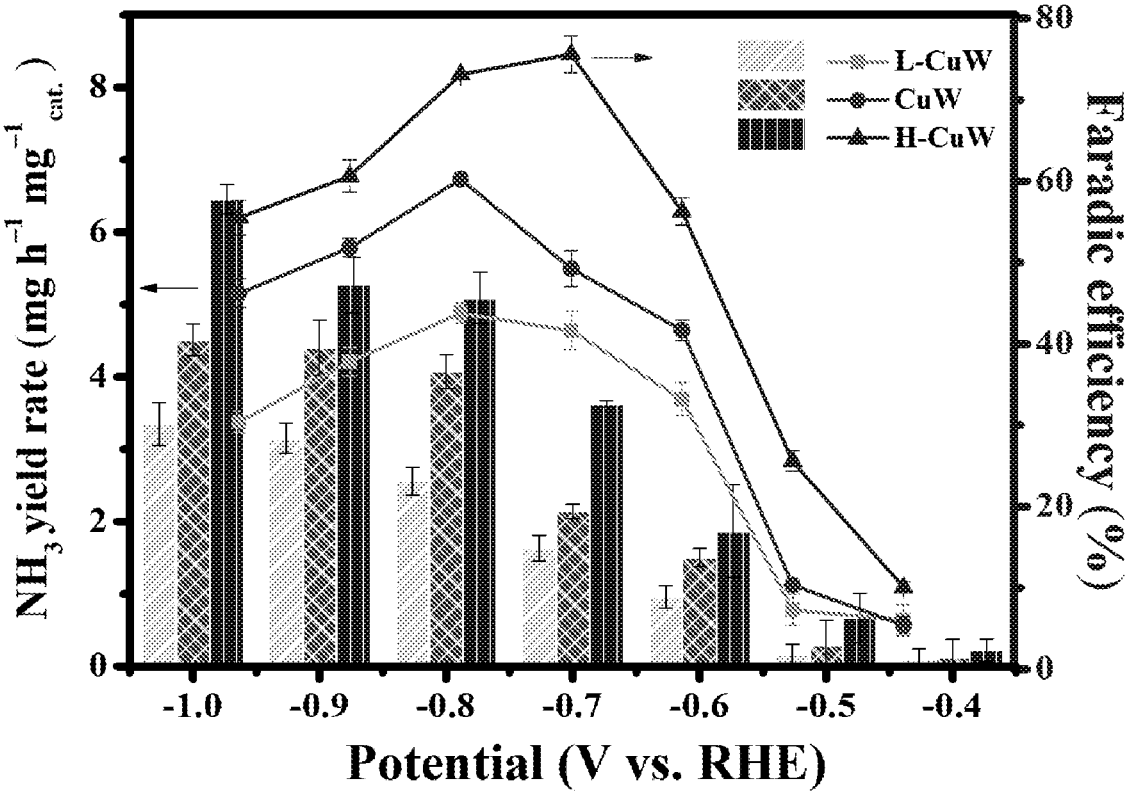
FIG. 10B depicts $NH_3$ yield rate and Faradaic efficiency of L—CuW, CuW, and H—CuW.
Figure 10C:
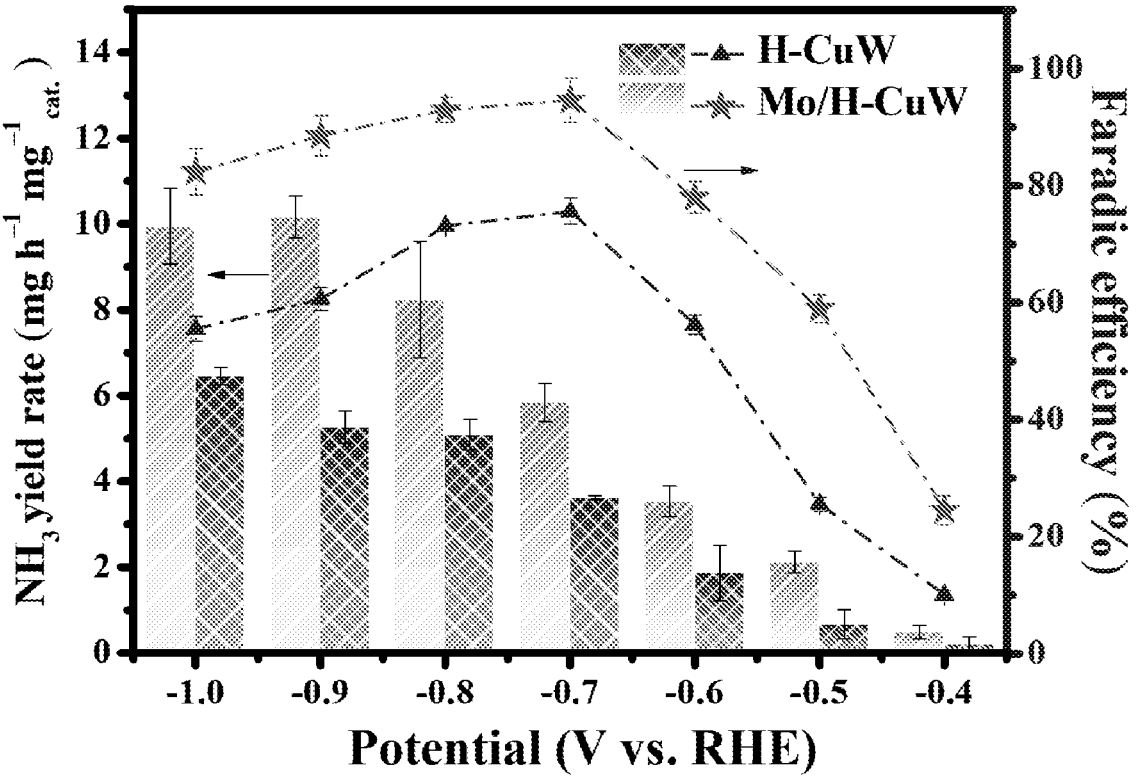
FIG. 10C depicts $NH_3$ yield rate and Faradaic efficiency of H—CuW and Mo/H—CuW.

To obtain the $NH_3$ yield rate and FE, a series of controlled-potential CA measurements were carried out in $NO_3$—contained electrolyte. As shown in FIG. 10B, H—CuW hollow nanospheres achieved the highest $NH_3$ FE of 75.61% with a yield rate of 3.63 mg $h^{-1}$ $mg_{cat.}^{-1}$ at −0.70 V vs. RHE, significantly outperforming L—CuW (FE of 41.63% and yield rate of 1.63 mg $h^{-1}$ $mg_{cat.}^{-1}$) and CuW HNS (FE of 49.25% and yield rate of 2.14 mg $h^{-1}$ $mg_{cat.}^{-1}$). The highest FE of H—CuW appears at a more positive potential than the counterparts, which means it only needs a smaller voltage to achieve the higher $NO_3^-$ reduction efficiency, emphasizing the selectivity of CuW with high concentration of $O_v$ sites As shown in FIG. 10C, in connection with the effect of potential change, the $NH_3$ yield rate of Mo/H—CuW gradually increases as the reduction potential increases from −0.4 V to −1.0 V, offering the $NH_3$yield rate of 5.84±0.45 mg $h^{-1}$ $mg_{cat.}^{-1}$ at −0.7 V vs. RHE. The highest FE reaches 94.60±3.75% at −0.7 V vs. RHE, surpassing those of H—CuW and L—CuW by a factor of 1.25 and 2.27, respectively.

Figure 11:
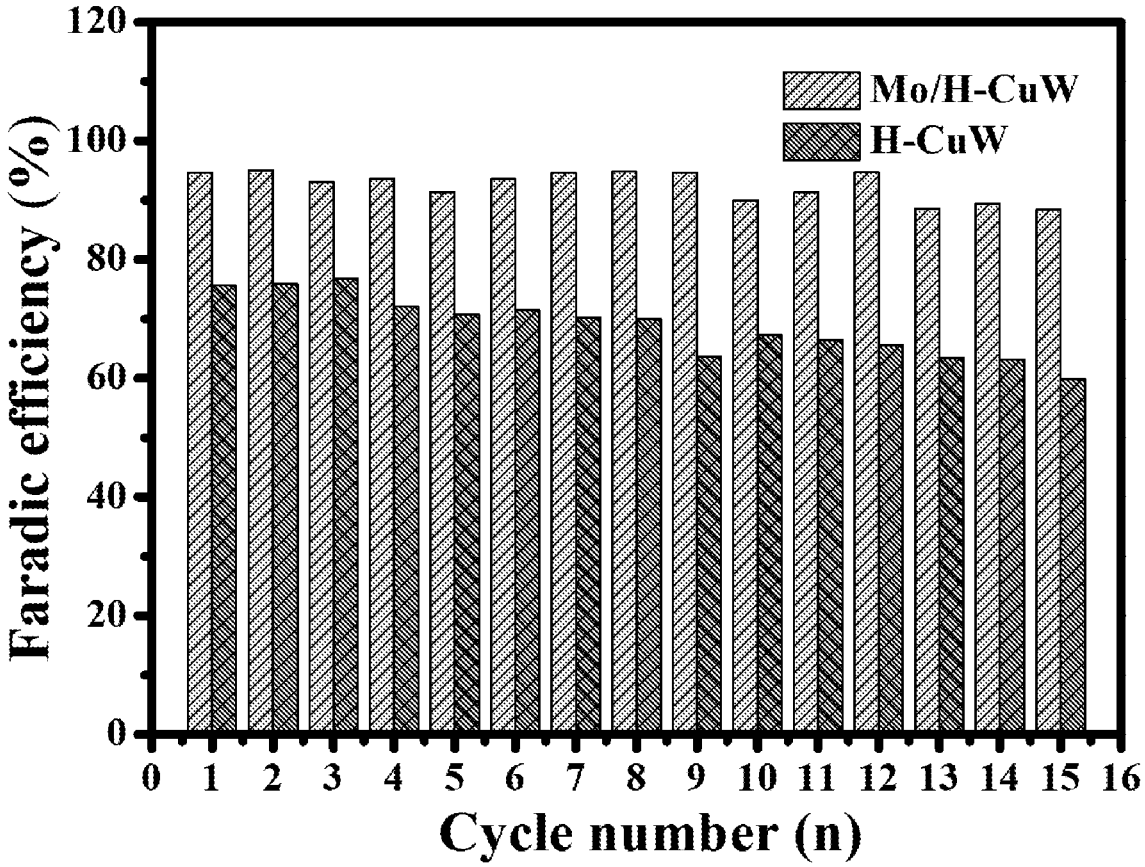

Referring now to FIG. 11, the $NH_3$FE for H—CuW shows an apparent descending tendency after 15 cycles compared to Mo/H—CuW. It is inferred that the reduction is caused by the fugitiveness of $O_v$. Although the asymmetric $O_v$ could theoretically balance the adsorption/desorption of O in $NO_3^-$, the practical experiments of H—CuW indicate that it has a relatively slow kinetic for the eight-electron transfer reduction process. Thus, less and less $O_v$ is left to absorb additional $NO_3^-$ due to the fugitiveness as the number of cycles increases. However, when loading the Mo clusters onto H—CuW, the $NH_3FE$ fluctuates but still maintains at around 90%, confirming the synergistic effect between asymmetric $O_v$ and Mo clusters. It is known that the bridge or hollow site adsorption is available on the Mo metal surface for the strong *N binding strength and relatively stable *H. Therefore, this synergistic effect could not only promote the $NO_3RR$/HER selectivity but also accelerate the protonation steps in $NO_3RR$. This is why the $O_v$-only H—CuW displays the decreasing efficiency after repetitive use, but the Mo/H—CuW does not.

According to another aspect of the present disclosure, there is provided a method of making a catalyst, including forming a $CuWO_4$ hollow nanosphere by a hydrothermal process followed by a thermal treatment, plasma-treating the $CuWO_4$ hollow nanosphere with a plasma to introduce oxygen vacancies, and introducing Mo clusters; wherein the hydrothermal process includes mixing a copper source, a tungsten source, and an adjuvant to form a solution; heating the solution to form a precursor precipitate; and drying the precursor precipitate. In an example, the thermal treatment includes annealing the precursor precipitate to form a $CuWO_4$ hollow nanosphere.

According to another aspect of the present disclosure, there is provided a method of making a catalyst ink, including forming a solution including a plurality of $CuWO_4$ hollow nanospheres, Nafion; and sonicating the solution to form a homogeneous catalyst ink. In an example, the solution further includes one or more of ethanol, acetone, or water, or any combination thereof. In an example, a first solution may be prepared including deionized water:ethanol in about a 1:3 ratio by volume. In another example, a second solution may be prepared including 40 μL of 5 wt. % Nafion and 960 μL of the first solution. In yet another example, a second solution may be prepared including 40 μL of 5 wt. % Nafion and 960 μL of ethanol. In still another example, a second solution may be prepared including 40 μL of 5 wt. % Nafion and 960 μL of acetone. In an example, catalyst is added to the second solution and then sonicated in an ultrasonic cleaning machine to form a homogeneous catalyst ink. In another example, the amount of catalyst added to the second solution is in a range of about 5 mg to about 10 mg, including all ranges and subranges therein, e.g., about 5 mg to about 7 mg, about 6 mg to about 8 mg, about 7 mg to about 9 mg, about 8 mg to about 10 mg, about 5 mg to about 6 mg, about 6 mg to about 7 mg, about 7 mg to about 8 mg, about 8 mg to about 9 mg, about 9 mg to about 10 mg, etc. In yet another example, the sonicating occurs for about 30 minutes to about 90 minutes, including all ranges and subranges therein, e.g., about 30 30 minutes to about 60 minutes, about 60 minutes to about 90 minutes, about 30 minutes to about 45 minutes, about 45 minutes to about 60 minutes, about 60 minutes to about 75 minutes, about 75 minutes to about 90 minutes, about 30 minutes to about 40 minutes, about 40 minutes to about 50 minutes, about 50 minutes to about 60 minutes, about 60 minutes to about 70 minutes, about 70 minutes to about 80 minutes, about 80 minutes to about 90 minutes, etc.

A $CuWO_4$ Hollow Nanosphere

According to an aspect of the present disclosure, there is provided a composition including a $CuWO_4$ hollow nanosphere; asymmetric oxygen vacancies within the $CuWO_4$ hollow nanosphere; and Mo clusters within the $CuWO_4$ hollow nanosphere, wherein the Mo clusters are adjacent to the asymmetric oxygen vacancies.

The concentration of asymmetric oxygen vacancies in the $CuWO_4$ hollow nanosphere may be controlled during synthesis by treating the $CuWO_4$ hollow nanosphere with plasma for a specific length of time. Non-limiting examples of plasma include $O_2$ and Ar. In an example, the $CuWO_4$ hollow nanosphere is exposed to Ar plasma, thereby increasing the concentration of oxygen vacancies. In another example, the $CuWO_4$ hollow nanosphere is exposed to $O_2$ plasma, thereby decreasing the concentration of oxygen vacancies. In yet another example, the length of time that the $CuWO_4$ hollow nanosphere is exposed to plasma may be in a range of about 300 seconds to about 600 seconds, including all ranges and subranges therein, e.g., about 300 seconds to about 330 seconds, about 330 seconds to about 360 seconds, about 360 seconds to about 390 seconds, about 390 seconds to about 420 seconds, about 420 seconds to about 450 seconds, about 450 seconds to about 480 seconds, about 480 seconds to about 510 seconds, about 510 seconds to about 540 seconds, about 540 seconds to about 570 seconds, about 570 seconds to about 600 seconds, etc.

In still another example, the diameter of the $CuWO_4$ hollow nanosphere may be in a range of about 300 nm to about 450 nm, including all ranges and subranges therein, e.g., about 300 nm to about 235 nm, about 325 nm to about 350 nm, about 350 nm to about 375 nm, about 375 nm to about 400 nm, about 400 nm to about 425 nm, about 425 nm to about 450 nm, etc.

In still another example, the $CuWO_4$ hollow nanosphere may index to triclinic phase $CuWO_4$ without any other detectable impurities.

In an example, the $CuWO_4$ hollow nanosphere may be made by any one of the methods described hereinabove.

In another example, the $CuWO_4$ hollow nanosphere may be used as a catalyst.

According to an aspect of the present disclosure, there is provided a catalyst including a plurality of $CuWO_4$hollow nanospheres; wherein the $CuWO_4$ hollow nanospheres include asymmetric oxygen vacancies within the $CuWO_4$ hollow nanosphere; and Mo clusters within the $CuWO_4$ hollow nanosphere, wherein the Mo clusters are adjacent to the asymmetric oxygen vacancies. The catalyst may be made by any one of the methods described hereinabove. In an example, the catalyst may be used for efficient ammonia electrosynthesis.

In yet another example, the $CuWO_4$ nanosphere may be used in a catalyst ink.

According to an aspect of the present disclosure, there is provided a catalyst ink including a plurality of $CuWO_4$ hollow nanospheres, Nafion, ethanol, and water. The plurality of $CuWO_4$ hollow nanospheres may be made by any one of the methods described hereinabove.

An Electrode Including a Plurality of $CuWO_4$ Hollow Nanospheres

According to an aspect of the present disclosure, there is provided an electrode including a support and a catalyst ink. In an example, the support may be a clean carbon cloth. In another example, the support may be a glassy carbon electrode. In another example, the carbon cloth may be prepared by washing the cloth with acetone, ethanol, and deionized water. In yet another example, the carbon cloth may be washed multiple times with acetone, ethanol, and deionized water. In yet another example, the carbon cloth may be sonicated in one or more of acetone, ethanol, or deionized water, or any combination thereof. In still another example, the glassy carbon electrode may be polished by abrasive paper for metallograph. In a further example, the glassy carbon electrode may be polished on the suet with the suet including a $Al_2O_3$ slurry coating. In yet a further example, the glassy carbon electrode may be sonicated in ethanol, diluted $HNO_3$, and deionized water.

In still another example, the catalyst ink includes a catalyst, Nafion, ethanol, and water, as described above. In a further example, the catalyst includes a plurality of $CuWO_4$ hollow nanospheres, as described above. In an example, the electrode described in the present disclosure may be used for nitrate reduction.

According to an aspect of the present disclosure, there is provided a method of preparing an electrode for nitrate reduction, including forming a solution comprising a plurality of $CuWO_4$ hollow nanospheres, Nafion; sonicating the solution to form a homogeneous catalyst ink; and applying the catalyst ink to a support to obtain the electrode. In an example, the solution further includes one or more of ethanol, acetone, or water, or any combination thereof.

In another example, a solution may be prepared including 5 wt. % Nafion and deionized water/ethanol. In yet another example, the ratio of deionized water to ethanol in the solution may be about 1:3 by volume. In still another example, the catalyst may be dispersed in the solution. In a further example, the solution with dispersed catalyst may be sonicated to form a homogeneous catalyst ink. In yet another example, the solution with catalyst is sonicated for about 30 minutes to about 90 minutes, including all ranges and subranges therein, e.g., about 30 minutes to about 60 minutes, about 60 minutes to about 90 minutes, about 30 minutes to about 50 minutes, about 50 minutes to about 70 minutes, about 70 minutes to about 90 minutes, about 30 minutes to about 45 minutes, about 45 minutes to about 60 minutes, about 60 minutes to about 75 minutes, about 75 minutes to about 90 minutes, about 30 minutes to etc.

For example, the solution with dispersed catalyst may be sonicated in an ultrasonic cleaning machine for about 1 h to form a homogeneous catalyst ink. In yet a further example, the catalyst ink is applied to the clean carbon cloth and dried at room temperature. In an example, the carbon cloth may be cleaned with acetone, ethanol, and deionized water one or more times.

In yet a further example, the catalyst ink is applied to the support material. In still a further example, the catalyst ink is dropped onto the support material.

In an example, the electrode exhibits a high $NH_3$ Faradaic efficiency of about 94.60±3.75%. In another example, the electrode exhibits a yield rate of about 5.84±0.45 mg $h^{-1}$ $mg_{cat.}^{-1}$ at −0.7 V versus RHE.

In yet another example, the $CuWO_4$ hollow nanospheres include: $CuWO_4$, wherein each O atom is linked to at least one W atom and at least one Cu atom; asymmetric oxygen vacancies; and Mo clusters, wherein the Mo clusters are adjacent to the asymmetric oxygen vacancies. In still another example, the concentration of asymmetric oxygen vacancies is low. In a further example, the concentration of asymmetric oxygen vacancies is high.

EXAMPLES

Synthesis of $CuWO_4$ Hollow Nanospheres

In an example, copper chloride dihydrate ($CuCl_2 \cdot 2H_2O$) and sodium tungstate dihydrate ($Na_2WO_4 \cdot 2H_2O$) acted as the source of Cu and W, and sodium citrate dihydrate ($C_6H_5O_7Na_3 \cdot 2H_2O$) was used as an adjuvant to control the growth of hollow nanospheres structure. In an example, 50 mM $CuCl_2 \cdot 2H_2O$ and 50 mM $C_6H_5O_7Na_3 \cdot 2H_2O$ were dissolved in deionized water under magnetic stirring to form a homogeneous solution, followed by adding 25 mM $Na_2WO_4 \cdot 2H_2O$. The homogeneous solution was poured into 100 mL sealed Teflon-lined autoclave and then transferred to an oven set at 160° C. After a certain time (6 h, 24 h, and 48 h) for hydrothermal reaction, the precipitate in the solution was collected by centrifugation and washed with deionized water and ethanol for several times. The obtained green powder ($Cu_2WO_4(OH)_2$) was finally annealed at 400° C. for 1 h in air atmosphere to be oxidized into brown powders ($CuWO_4$).

Synthesis of $CuWO_4$ Hollow Nanospheres with Varying Ov and Mo Clusters

In an example, plasma treatment was used to prepare $CuWO_4$ HNS with different concentrations of Ov. $CuWO_4$ hollow nanosphere powder was put into quartz boats and transferred into the plasma chamber, where it was exposed to plasma. The $CuWO_4$ hollow nanosphere powder was exposed to $O_2$ plasma for 300 seconds with RF power of 200 W, resulting in $CuWO_4$ hollow nanospheres with low concentration of $O_v$ (L—CuW). In another example, the $CuWO_4$ hollow nanosphere powder was exposed to Ar plasma for 300 seconds with a gas flow of 10 sccm, resulting in $CuWO_4$hollow nanospheres with high concentration of $O_v$ (H—CuW).

After plasma treatment, the L—CuW, or H—CuW, were subjected to vigorous magnetic stirring at constant temperature (80° C.) in a 10 mL solution including 20 mg ammonium paramolybdate ($(NH_4)_6Mo_7O_{24} \cdot 4H_2O$). The resulting powders were then washed with deionized water and ethanol, and then dried at 80° C. for 12 h and annealed at 100° C. for 1 h in $H_2$/Ar atmosphere. The Mo-treated L—CuW and H—CuW are referred herein as Mo/L—CuW and Mo/H—CuW, respectively.

Preparation of Electrodes Including $CuWO_4$ Hollow Nanospheres

In an example, an electrode including the $CuWO_4$ hollow nanosphere catalyst described above was prepared as follows:

- cleaning a carbon cloth (CC, 1 cm×1 cm) with acetone, ethanol, and deionized water several times;
- preparing a solution including 40 μL of 5 wt. % Nafion and 960 μL of deionized water/ethanol (v/v=1:3);
- dispersing 5 mg of the catalyst in the solution;
- sonicating the solution in an ultrasonic cleaning machine for 1 h to form a homogeneous catalyst ink; and
- applying 50 μL of the catalyst ink on the clean carbon cloth and drying at room temperature.

All the electrochemical measurements were conducted on Gamry G300 potential station in an H-type electrolytic cell separated by a Nafion 117 membrane (DuPont) in a typical standard three-electrode system, in which the above as-prepared catalyst/CC act as a working electrode, and a piece of CC and Ag/AgCl (Saturated KCl electrolyte) represent the counter and reference electrode, respectively.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

Terms like "obtainable" or "definable" and "obtained" or "defined" are used interchangeably. This, for example, means that, unless the context clearly dictates otherwise, the term "obtained" does not mean to indicate that, for example, an embodiment must be obtained by, for example, the sequence of steps following the term "obtained" though such a limited understanding is always included by the terms "obtained" or "defined" as a preferred embodiment.

Approximating language, as used herein throughout disclosure, may be applied to modify any quantitative representation that could permissibly vary without resulting in a change in the basic function to which it is related. Accordingly, a value modified by a term or terms, such as "about" or "substantially," is not limited to the precise value specified. For example, these terms can refer to an amount that is within ±10% of the recited value, an amount that is within ±5% of the recited value, less than or equal to ±2%, an amount that is within ±1% of the recited value, an amount that is within ±0.5% of the recited value, an amount that is within ±0.2% of the recited value, an amount that is within ±0.1% of the recited value, or an amount that is within ±0.05% of the recited value. In some instances, the approximating language may correspond to the precision of an instrument for measuring the value.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present disclosure have been described and depicted herein, alternative aspects and embodiments may be affected by persons having ordinary skill in the art to accomplish the same objectives. Accordingly, this disclosure and the appended claims are intended to cover all such further and alternative aspects and embodiments as fall within the true spirit and scope of the present disclosure.

What is claimed is:

1. A catalyst comprising:

a $CuWO_4$ hollow nanosphere;

asymmetric oxygen vacancies within the $CuWO_4$ hollow nanosphere;

Mo clusters within the $CuWO_4$ hollow nanosphere, wherein the Mo clusters are adjacent to the asymmetric oxygen vacancies; and wherein the catalyst exhibits one or both of (i) a $NH_3$ Faradaic efficiency of 94.60±3.75% and (ii) a yield rate of about 5.84±0.45 mg $h^{-1}$ $mg_{cat.}^{-1}$ at −0.7 V versus RHE.

2. The catalyst of claim 1, wherein the diameter of the $CuWO_4$ hollow nanosphere is in a range of about 300 nm to about 450 nm.

3. The catalyst of claim 1, wherein the catalyst is made by a method comprising:

forming a $CuWO_4$ hollow nanosphere by a hydrothermal process followed by a thermal treatment;

plasma-treating the $CuWO_4$ hollow nanosphere with a plasma to introduce oxygen vacancies; and introducing Mo clusters adjacent to the oxygen vacancies;

wherein the hydrothermal process comprises mixing a copper source, a tungsten source, and an adjuvant to form a solution, heating the solution to form a precursor precipitate, and drying the precursor precipitate; and wherein the thermal treatment comprises annealing the precursor precipitate to form a $CuWO_4$ hollow nanosphere.

4. The catalyst of claim 1, wherein the catalyst is characterized by one or more of:

(i) a Cu 2p spectra with a Cu $2p_{1/2}$ peak at about 954.58 eV and a Cu $2p_{3/2}$ peak at about 934.50 eV; and (ii) a W 4f spectra with a W $4f_{5/2}$ peak at about 37.74 eV and a W $4f_{7/2}$ peak at about 35.57 eV.

5. The catalyst of claim 1, wherein the catalyst is characterized by one or more of:

(i) a Cu 2p spectra with a Cu $2p_{1/2}$ peak at about 953.80 eV and a Cu $2p_{3/2}$ peak at about 933.80 eV; and (ii) a W 4f spectra with a W $4f_{5/2}$ peak at about 37.73 eV and a W $4f_{7/2}$ peak at about 35.62 eV.

6. The catalyst of claim 1, wherein the $CuWO_4$ hollow nanospheres have an A/B ratio of about 0.86.

7. The catalyst of claim 1, wherein the $CuWO_4$ hollow nanospheres have an A/B ratio of about 1.32.

8. A method of preparing an electrode for nitrate reduction, the method comprising:

forming a solution comprising the catalyst of claim 1 and Nafion;

sonicating the solution to form a homogeneous catalyst ink; and applying the catalyst ink to a support to obtain the electrode.

9. The method of claim 8, wherein the solution further comprises one or more of ethanol, acetone, or water, or any combination thereof.

10. The method of claim 8, wherein the electrode exhibits one or both of (i) a high $NH_3$ Faradaic efficiency of about 94.60±3.75%, and (ii) a yield rate of about 5.84±0.45 mg $h^{-1}$ at $mg_{cat.}^{-1}$ at −0.7 V versus RHE.

11. A method of making the catalyst of claim 10, comprising:

forming a $CuWO_4$ hollow nanosphere by a hydrothermal process followed by a thermal treatment;

plasma-treating the $CuWO_4$ hollow nanosphere with a plasma to introduce oxygen vacancies; and introducing Mo clusters adjacent to the oxygen vacancies;

wherein the hydrothermal process comprises mixing a copper source, a tungsten source, and an adjuvant to form a solution, heating the solution to form a precursor precipitate, and drying the precursor precipitate; and wherein the thermal treatment comprises annealing the precursor precipitate to form a $CuWO_4$ hollow nanosphere.

12. The method of claim 11, wherein the copper source is a water-soluble copper salt, the tungsten source is a water-soluble tungsten salt, and the adjuvant is sodium citrate dihydrate ($C_6H_5O_7Na_3 \cdot 2H_2O$).

13. The method of claim 11, wherein a ratio of copper source: adjuvant: tungsten source is in a range of about 1:1:0.5 to about 1:1:1.

14. The method of claim 11, wherein heating is performed at a temperature in a range of about 160° C. to about 180° C. for about 22 hours to about 26 hours.

15. The method of claim 11, wherein annealing the precursor precipitate is performed at a temperature in a range of about 350° C. to about 450° C. for about 1 hour to about 2 hours.

16. The method of claim 11, wherein plasma-treating comprises one or both of (i) exposing the $CuWO_4$ hollow nanosphere to a plasma for about 300 seconds to about 600 seconds; and (ii) exposing the $CuWO_4$ hollow nanosphere to a plasma with a RF power of about 200 W and a gas flow in a range of about 10 sccm to about 20 sccm.

17. The method of claim 11, wherein introducing Mo clusters comprises (i) mixing polyoxomolybdate and the plasma-treated $CuWO_4$ hollow nanosphere in water and evaporating the solution to obtain a powder comprising the plasma-treated $CuWO_4$ hollow nanosphere with Mo cluster inclusions; and (ii) annealing the powder at a temperature in a range of about 80° C. to about 100° C. for about 1 hour to about 2 hours in $H_2$/Ar atmosphere.

* * * * *